US007012370B2

(12) United States Patent
Kanazawa et al.

(10) Patent No.: US 7,012,370 B2
(45) Date of Patent: Mar. 14, 2006

(54) PLASMA DISPLAY DEVICE WITH SHIELDING PARTS ON TRANSPARENT ELECTRODES

(75) Inventors: Yoshikazu Kanazawa, Kawasaki (JP); Shigeharu Asao, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/881,740

(22) Filed: Jun. 18, 2001

(65) Prior Publication Data

US 2002/0008473 A1 Jan. 24, 2002

(30) Foreign Application Priority Data

Sep. 4, 2000 (JP) ..... 2000-267272

(51) Int. Cl.
*H01J 17/49* (2006.01)

(52) U.S. Cl. ..... 313/582; 313/585; 313/586; 313/587; 313/326

(58) Field of Classification Search ..... 313/582, 313/585–587, 495, 496–497, 326, 313; 345/37, 345/41, 60; 315/169.4
See application file for complete search history.

(56) References Cited

U.S. PATENT DOCUMENTS 5,587,624 A * 12/1996 Komaki ..... 313/584
5,640,068 A 6/1997 Amemiya (Continued)

FOREIGN PATENT DOCUMENTS

| | | |
|---|---|---|
| EP | 0 945 887 | 9/1999 |
| EP | 1 017 081 | 7/2000 |
| EP | 1 030 340 | 8/2000 |
| EP | 1 032 015 | 8/2000 |

OTHER PUBLICATIONS

Patent Abstracts of Japan of JP 09-160525 dated Jun. 20, 1997.

(Continued)

*Primary Examiner*—Ashok Patel
(74) *Attorney, Agent, or Firm*—Staas & Halsey LLP

(57) ABSTRACT

A plurality of discharge electrodes having transparent electrodes connected to bus electrodes are arranged on the inner side of a front substrate. Alternatively, discharge electrodes having transparent electrodes and capable of discharging between their respective neighboring electrodes on both sides are arranged on the inner side of the front substrate. The front substrate is provided on the side of the display surface where discharge-generated light radiates out to the exterior. Shielding parts for shielding incident light from the exterior are formed on the transparent electrodes, or along the front substrate. Accordingly, the shielding parts reduce the surface reflection to improve the bright room contrast ratio. Forming the shielding parts with the same material as that of the bus electrodes prevents fabrication processes from becoming complicated. The areas of the shielding parts can be varied with the luminescent colors of cells, to change the luminescent brightness by the cell.

30 Claims, 17 Drawing Sheets

U.S. PATENT DOCUMENTS 5,952,782 A * 9/1999 Nanto et al. ..... 313/584
5,962,974 A * 10/1999 Komaki et al. ..... 313/582
5,977,708 A * 11/1999 Amatsu et al. ..... 313/586
5,986,391 A * 11/1999 Feldman ..... 313/326
6,013,983 A * 1/2000 Asano et al. ..... 313/581
6,034,474 A * 3/2000 Ueoka et al. ..... 313/584
6,097,149 A * 8/2000 Miyaji et al. ..... 313/582
6,097,357 A * 8/2000 Shinoda et al. ..... 345/63
6,137,226 A * 10/2000 Nagano ..... 313/582
6,172,461 B1 * 1/2001 Ha ..... 313/585
6,195,070 B1 * 2/2001 Shinoda et al. ..... 345/60

OTHER PUBLICATIONS

Patent Abstracts of Japan of JP 09-237580 dated Sep. 9, 1997.

* cited by examiner

Prior Art

Prior Art

Prior Art

Prior Art

Prior Art

PLASMA DISPLAY DEVICE WITH SHIELDING PARTS ON TRANSPARENT ELECTRODES

BACKGROUND OF THE INVENTION

1. Field of the Invention

The present invention relates to a plasma display panel, and more particularly to a technology for improving a bright room contrast ratio.

2. Description of the Related Art

Plasma display panels (hereinafter, also referred to as PDPs) are display panels of self-luminous type, and are receiving attention as display panels that replace CRTs (Cathode Ray Tubes) by virtue of their high visibility and low profiles. A PDP is formed by filling discharge gas into a space of the order of 100 microns sandwiched between two glass substrates (a front substrate 26 and a rear substrate 34 in FIG. 2 to be described later) which are provided with electrodes. One of the glass substrate is coated with phosphors. Then, a voltage higher than or equal to a starting voltage is applied between the electrodes to cause a discharge, and the ultraviolet rays generated from the discharge make the phosphors excitation-luminous for pixel luminescence.

FIG. 1 shows an overview of one PDP 10 called a surface-discharge alternating-current type, among PDPs of this kind.

The PDP 10 is provided with a plurality of pairs of discharge electrodes 12 and 14 which extend in the horizontal direction of the diagram, and a plurality of address electrodes which are orthogonal to these discharge electrodes 12 and 14. The discharge electrodes 12 and 14 include transparent electrodes 18 and nontransparent bus electrodes 20 formed on these transparent electrodes 18. The transparent electrodes 18 are formed of tin oxide ($SnO_2$) or ITO (a transparent conductor consisting mainly of indium oxide), and have a relatively high resistance. The bus electrodes 20 are formed of metal such as copper. These bus electrodes 20 lower the resistances of the discharge electrodes 12 and 14.

Besides, a pair of discharge electrodes 12 and 14 form a display line L. A predetermined gap (non-display area) is arranged between neighboring display lines L so that the discharge electrodes 12 and 14 will not cause any accidental discharge across the two lines. In order to avoid a drop in bright room contrast ratio due to external light reflection, a black stripe 22 is formed in this gap.

Ribs 24 are formed between and along these address electrodes 16. Then, the regions surrounded by the black stripes 20 and the ribs 24 form cells C, or light emission units.

As shown in FIG. 2, the discharge electrodes 12, 14 and the black stripes 22 are formed on the inner, or interior, surface, adjacent the discharge space 28, of the front substrate 26, the exterior surface of which is a display surface for an observer. A dielectric layer 30 for holding a wall charge and a protection layer 32 made of magnesium oxide (MgO) are formed over the discharge electrodes 12, 14 and the black stripes 22.

Meanwhile, as shown in FIG. 3, the address electrodes 16 and the ribs 24 are formed on an inner, or interior, surface, adjacent the discharge space 28, of the rear substrate 34. A dielectric layer 36 is formed over the address electrodes 16. The ribs 24 are formed on this dielectric layer 36. Phosphor layers R, G, and B are formed over the inclined planes of the ribs 24 and the dielectric layer 36 surrounded by the ribs 24.

The phosphor layers R, G, and B respectively emit red light, green light, and blue light, by the incidence of discharge-generated ultraviolet rays. That is, in this example, a single pixel capable of full color display is composed of three cells.

In the above-described PDP, before pixel display, a reset pulse is applied to (i.e., across) the discharge electrodes 12 and 14 to initialize the cells (reset period). Then, address pulses are applied to address electrodes 16 that correspond to data to be displayed, thereby selecting cells C to emit light (address period). Then, sustain pulses are applied to (i.e., across) the discharge electrodes 12 and 14 over periods corresponding to the brightness gradations, to sustain discharges in the selected cells C (sustentation, or sustain, period). Ultraviolet rays generated from the sustain-discharge excite the phosphor layer R (or G, B) to emit light. Then, the light is transmitted through the transparent electrodes 18 and the front substrate 26 to radiate out to the exterior, thereby displaying an image.

FIG. 4 shows an overview of another PDP 38 disclosed in Japanese Patent No. 2801893 Gazette. This kind of PDP is referred to as ALIS (Alternate Lighting of Surfaces) technology.

The PDP 38 has a plurality of discharge electrodes 40 formed at regular intervals. Address electrodes 16 and ribs 24 are arranged as in FIG. 1. The black stripes 22 shown in FIG. 1 are not formed in this PDP 38. On this account, the discharge electrodes 40, except the electrodes 40 at opposite ends, or edges, can produce discharges, with their respective adjacent discharge electrodes 40 on both sides. That is, cells C, or light emission units, are formed to overlap with each other along the address electrodes 16. Display lines L are also formed to overlap with each other. As a result, given an equal definition (i.e., an equal number of lines L), the number of discharge electrodes is only about half that in the PDP 10 of FIG. 1. The absence of non-luminescence regions allows an improvement in brightness if the panel sizes are identical.

FIG. 5 shows a cross section of the PDP 38 taken along an address signal 16, and luminescent intensities along the cross section.

In the luminescent intensity (1), the solid line indicates the intensity for situations where the display line L1 emits light, and the broken line indicates the intensity for situations where the display line L2 emits light. More specifically, the luminescent intensity on each line reaches the maximum in the middle of the neighboring discharge electrodes 40, and decreases with distance from the middle. The display lines L1 and L2 repeat alternate luminescence successively. Therefore, the actual intensity distribution, as shown in the luminescent intensity (2), is given by the sum of the solid line and the broken line in the luminescent intensity (1). Accordingly, the entire PDP 38 offers the maximum luminescent intensity in the very middles of the spaces between discharge electrodes 40.

FIG. 6 shows a cross section of the PDP 38 taken along a discharge electrode, and luminescent intensities along the cross section.

The solid line indicates the luminescent intensity for situations where the ribs 24 are formed of nontransparent material, and the broken line indicates the luminescent intensity for situations where the ribs 24 are formed of a transparent dielectric or the like. The luminescent intensities have three peaks. Of these, one lies in the portion where the address electrode 16 and the discharge electrode 40 face each other, while the other two fall on the inclined planes of the ribs 24. The facing portion of the address electrode 16 and the discharge electrode 40 is where the discharge becomes the most active; a large amount of ultraviolet rays occur for higher luminescent intensity. The inclined planes of the ribs 24 increase in radiation density as seen from the side of the front substrate 26. On the inclined planes, the substantial radiations from the phosphor layer R (or G, B) strengthen each other to make the luminescent intensity higher than in the central part of the cell C.

By the way, the PDP 38 of ALIS technology shown in FIG. 4 improves in brightness as compared with the PDP 10 shown in FIG. 1, whereas it has a higher surface reflectance ratio because of having no non-luminescence regions other than the ribs 24 and the bus electrodes 20. Specifically, while the PDP 10 having the black stripes 22 shown in FIG. 1 is lower than or equal to 20% in surface reflectance ratio, the PDP 38 of ALIS technology shown in FIG. 4 reaches 30–40% in surface reflectance ratio. Consequently, the PDP 38 of ALIS technology had a problem that the external light reflection increases to lower the bright room contrast ratio.

If the bright room contrast ratio drops, the screen of the PDP 38 looks whitish all over in bright rooms. In general, PDPs are provided with an optical filter at their front to decrease the transmittance for the sake of higher bright room contrast ratios. Simply arranging an optical filter at the front, however, lowers the brightness of the entire screen.

SUMMARY OF THE INVENTION

It is an object of the present invention to improve the bright room contrast ratio of a plasma display panel. In particular, the object of the present invention is to improve the bright room contrast ratio of a plasma display panel of ALIS technology.

According to one of the aspects of the present invention, a plurality of discharge electrodes having transparent electrodes connected to bus electrodes are arranged on an inner side of a front substrate. The front substrate is provided on the side of the display-surface where discharge-generated light radiates out to the exterior. Shielding parts for shielding the incident light from exterior are formed on the transparent electrodes. Thus, the shielding parts reduce the surface reflection to improve the bright room contrast ratio.

According to another aspect of the present invention, a plurality of discharge electrodes having transparent electrodes, and capable of discharging between neighboring electrodes on both sides are arranged on the inner side of the front substrate. The transparent electrodes are connected to bus electrodes, respectively. That is, discharge at a discharge electrode occurs at one timing with the neighboring discharge electrode on one side, and at another timing with the discharge electrode on the other side. The front substrate is provided on the display-surface side where discharge-generated light radiates out to the exterior. Besides, shielding parts for shielding the incident light from exterior are formed along the front substrate. Therefore, even in the plasma display panel in which discharge can be made between neighboring discharge electrodes on both sides, the shielding parts reduce the surface reflection to improve the bright room contrast ratio.

When the discharge electrodes have the bus electrodes placed on the transparent electrodes as described above, the shielding parts may be formed of the same material as that of the bus electrodes. Moreover, the shielding parts may be formed integral with the bus electrodes. In this case, the shielding parts can be formed in the process of fabricating bus electrodes. That is, the bus electrodes and the shielding parts can be formed simultaneously, which prevents fabrication processes from becoming complicated. Besides, there is no need for any dedicated masks to form the shielding parts.

According to another aspect of the invention, the shielding parts are formed in conformity with portions with lower light luminescent intensities. Therefore, the bright room contrast ratio can be improved with a minimum drop in luminescent intensity.

According to another aspect of the present invention, a plurality of cells, which are units discharge-generated light is emitted in, are formed along the discharge electrodes neighboring each other. The shielding parts formed respectively in the cells have different areas depending on the luminescent colors of the cells. On this account, the brightness of cells that give off a predetermined color can be made higher than that of other cells. For example, the areas of the sheilding parts in cells emitting blue light are made smaller than those of the shielding parts in other cells emitting red light and green light, so that the brightness of the blue light relatively increases. Therefore, it is possible to increase the color temperature in displaying white while improving the bright room contrast ratio.

According to another aspect of the present invention, a rear substrate is arranged so that it faces the front substrate with a discharge space in between. A plurality of address eletrodes are parallel to each other, and placed along the rear substrate in a direction orthogonal to the discharge electrode. Ribs are formed along the spaces between the address electrodes. Then, cells, or light emission units, are formed in regions surrounded by two of the discharge electrodes neighboring each other and two of the ribs on both sides of one address electrode.

The cells each include, the transparent electrode having narrow projecting parts that project toward the center of the cell, and having opposing parts that are at the tips of the projecting parts and lie along the discharge electrodes. The shielding parts are formed on portions conforming to the portions with lower light luminescent intensities (for example, the projecting parts, portions of the opposing parts between the ribs and the centers of the opposing parts, or the sides of the bus-electrodes on the opposing parts).

According to another aspect of the present invention, a plurality of cells, which are units discharge-generated light is emitted in, are formed along the discharge electrodes neighboring each other. The cells include blue cells for emitting blue light. The shielding parts in the blue cells are formed in positions where they shield discharge-generated visible light. The shielding parts of the cells other than the blue cells are formed in conformity with portions where discharge-generated light has a low luminescent intensity. For example, external radiation produced by the blue cells, such as neon or other visible light, can be blocked to prevent a drop in color purity of the blue light while the bright room contrast ratio is improved by cells other than the blue cells.

BRIEF DESCRIPTION OF THE DRAWINGS

The nature, principle, and utility of the invention will become more apparent form the following detailed description when read in conjunction with the accompanying drawings in which like parts are designated by identical reference numbers, in which.

DESCRIPTION OF THE PREFERRED EMBODIMENTS

Hereinafter, embodiments of the present invention will be described with reference to the drawings.

Figure 7:
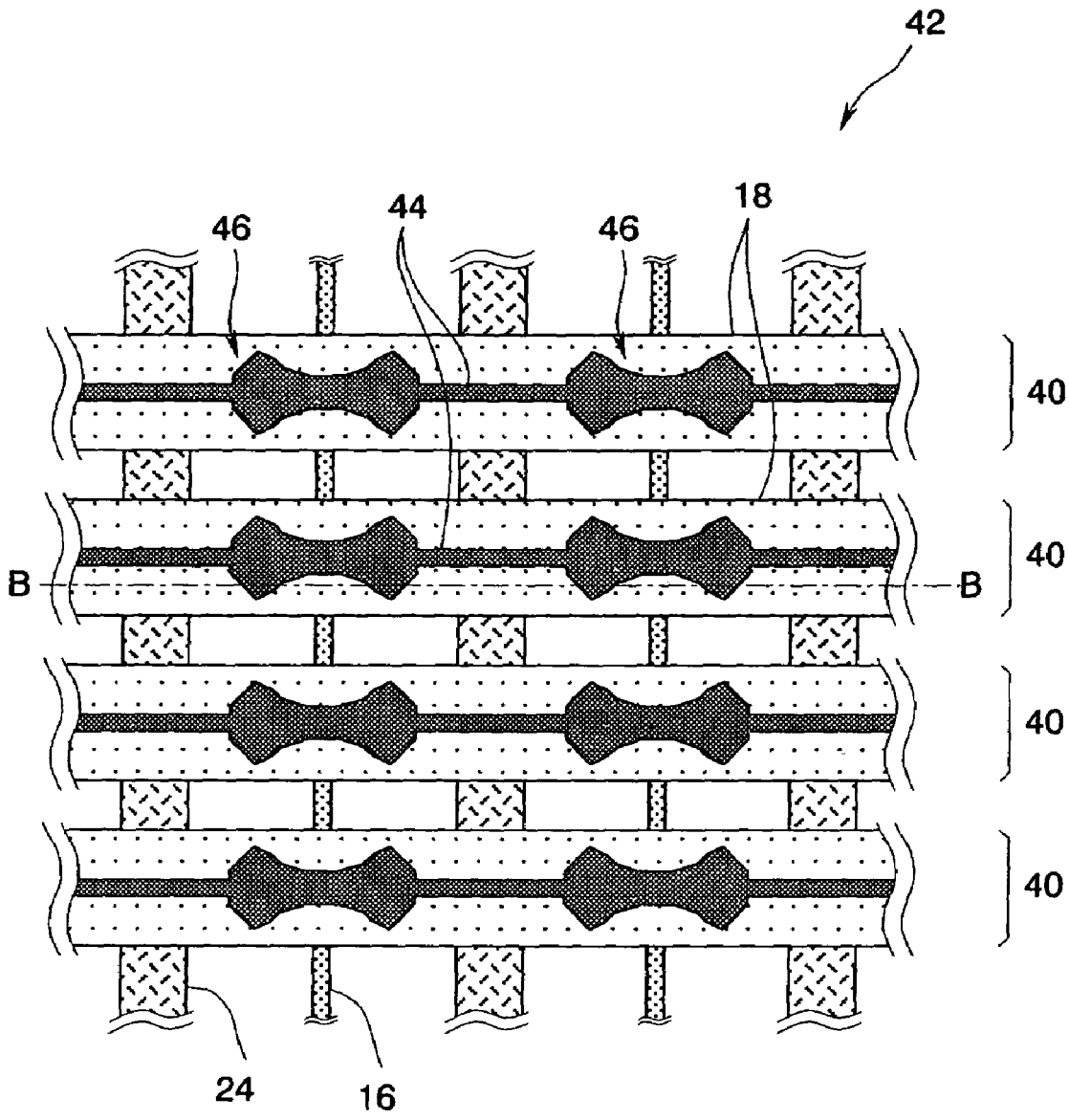
FIG. 7 is a plan view showing the essential parts of a first embodiment of the plasma display panel in the present invention.

FIG. 7 shows the essential parts of a first embodiment of the plasma display panel in the present invention. The same elements as those described in the conventional art will be designated by identical reference numbers. Detailed description thereof will be omitted.

Figure 4:
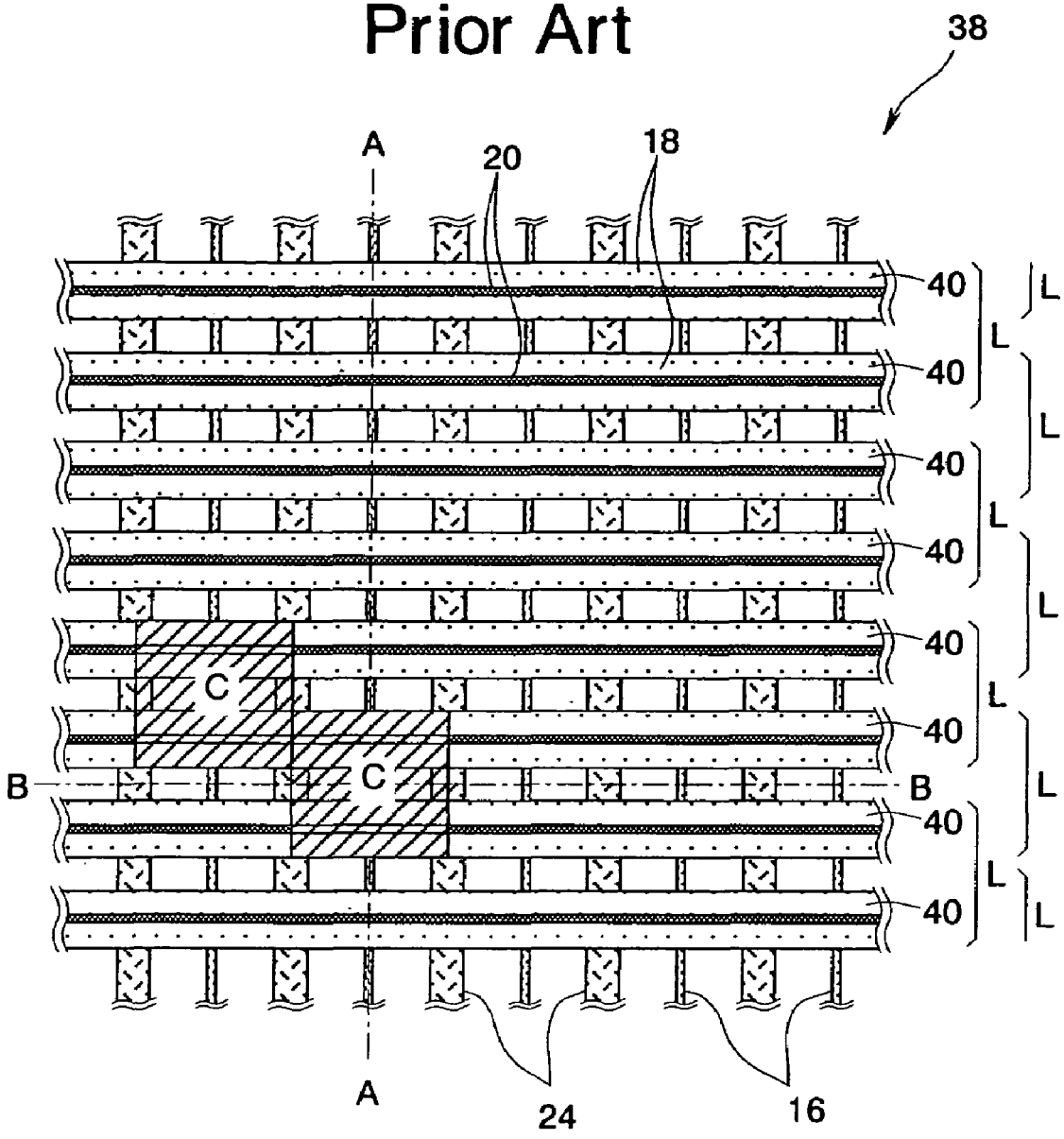
FIG. 4 is a plan view showing an overview of a conventional plasma display panel of ALIS technology.
Figure 5:
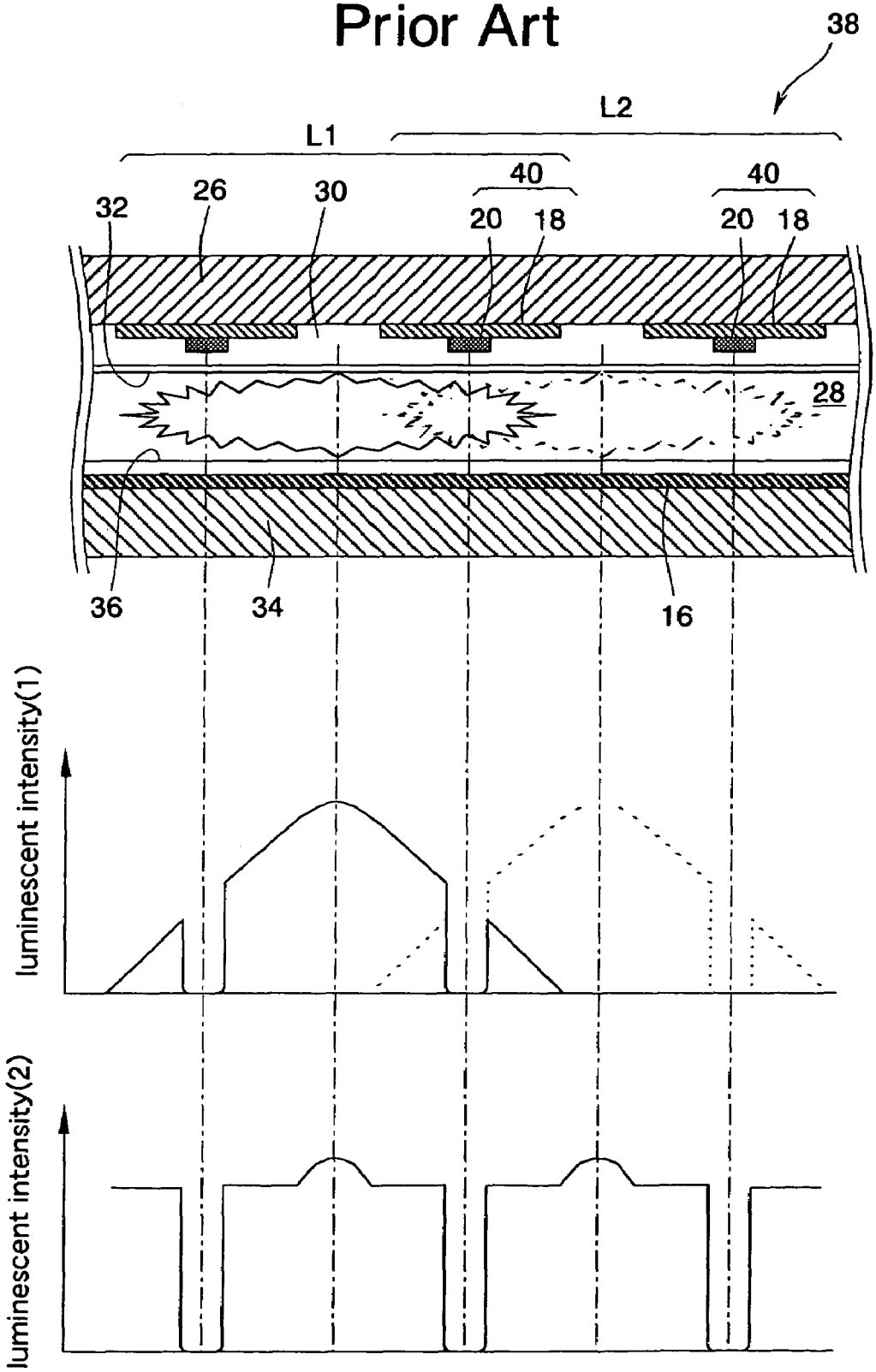
FIG. 5 is an explanatory diagram showing a cross section along the line A—A of FIG. 4 and luminescent intensities along the cross section.

This embodiment is formed as a PDP 42 of ALIS technology, having a plurality of discharge electrodes 40 formed at regular intervals. Bus electrodes 44 constituting the discharge electrodes 40 have a configuration different from heretofore. The arrangement of transparent electrodes 18 constituting the discharge electrodes 40 and the arrangement of address electrodes 16 and ribs 24 are nearly the same as those of FIG. 4.

The bus electrodes 44 are formed broader at portions lying between the address electrodes 16 and the ribs 24, and slightly broader at portions facing the address electrodes 16. These broader portions form shielding parts 46 for shielding light incident from exterior. That is, in this embodiment, the shielding parts 46 are formed integral with the bus electrodes 44. The bus electrodes 44 have a triple-layer structure including copper (Cu) sandwiched by chrome (Cr). Since the shielding parts 46 can be formed simultaneously-with the patterning of the bus electrodes 44, the fabrication process will not become complicated. In other words, the shielding parts 46 can be formed only by changing the mask pattern of the bus electrodes 44.

Figure 8:
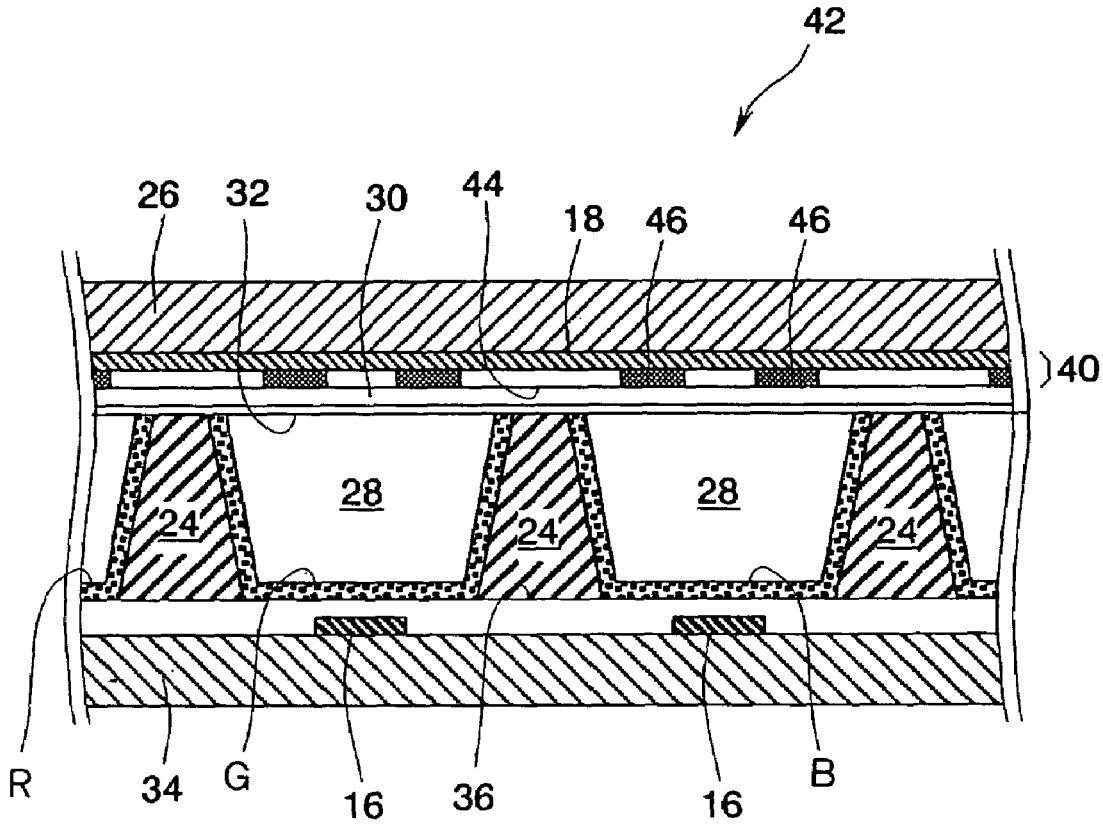
FIG. 8 is a cross-sectional view along the line B—B of FIG. 7.

FIG. 8 shows a cross section of the PDP 42 taken along a discharge electrode 40.

Figure 6:
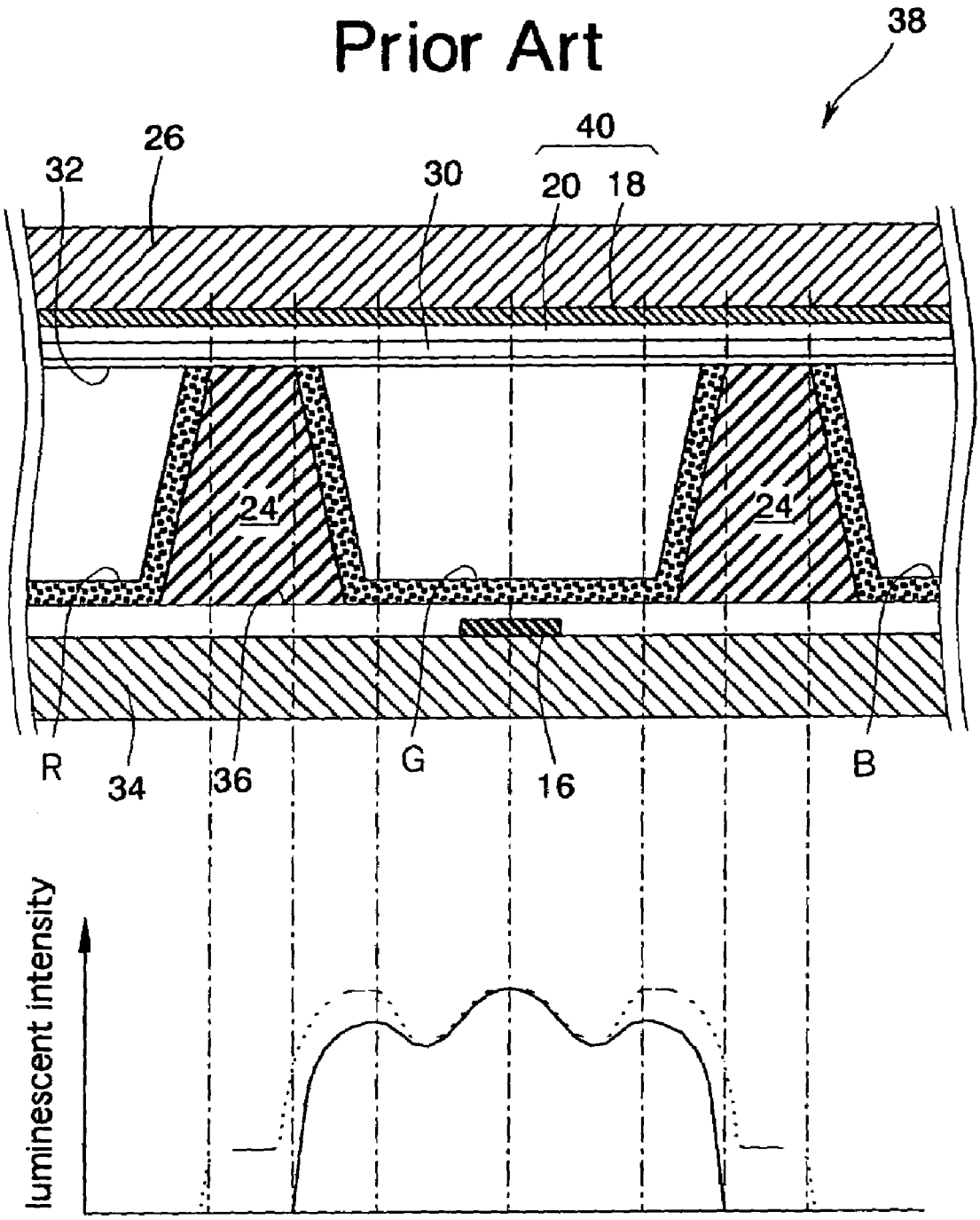
FIG. 6 is an explanatory diagram showing a cross section along the line B—B of FIG. 4 and luminescent intensities along the cross section.

As in FIG. 6, the PDP 42 has a front substrate 26 and a rear substrate 34 which are arranged to face, or oppose, each other across discharge space 28. The discharge space 28 is filled with, for example, mixed gas of neon (Ne) and xenon (Xe). The transparent electrodes 18 are formed on the interior surface, adjacent the discharge space 28, of the front substrate 26, and the shielding parts 46 (bus electrodes 44) are formed on (under, in the diagram) the transparent electrodes 18. A dielectric layer 30 and a protection layer 32 made of magnesium oxide (MgO) are formed over the discharge electrodes 40.

The address electrodes 16 are formed on the side with the discharge space 28 of the rear substrate 34. A dielectric layer 36 is formed over the address electrodes 16. The ribs 24 are formed on this dielectric layer 36. Phosphor layers R, G, and B are formed on the inclined planes of the ribs 24 and on the dielectric layer 36 surrounded by the ribs 24.

Figure 9:
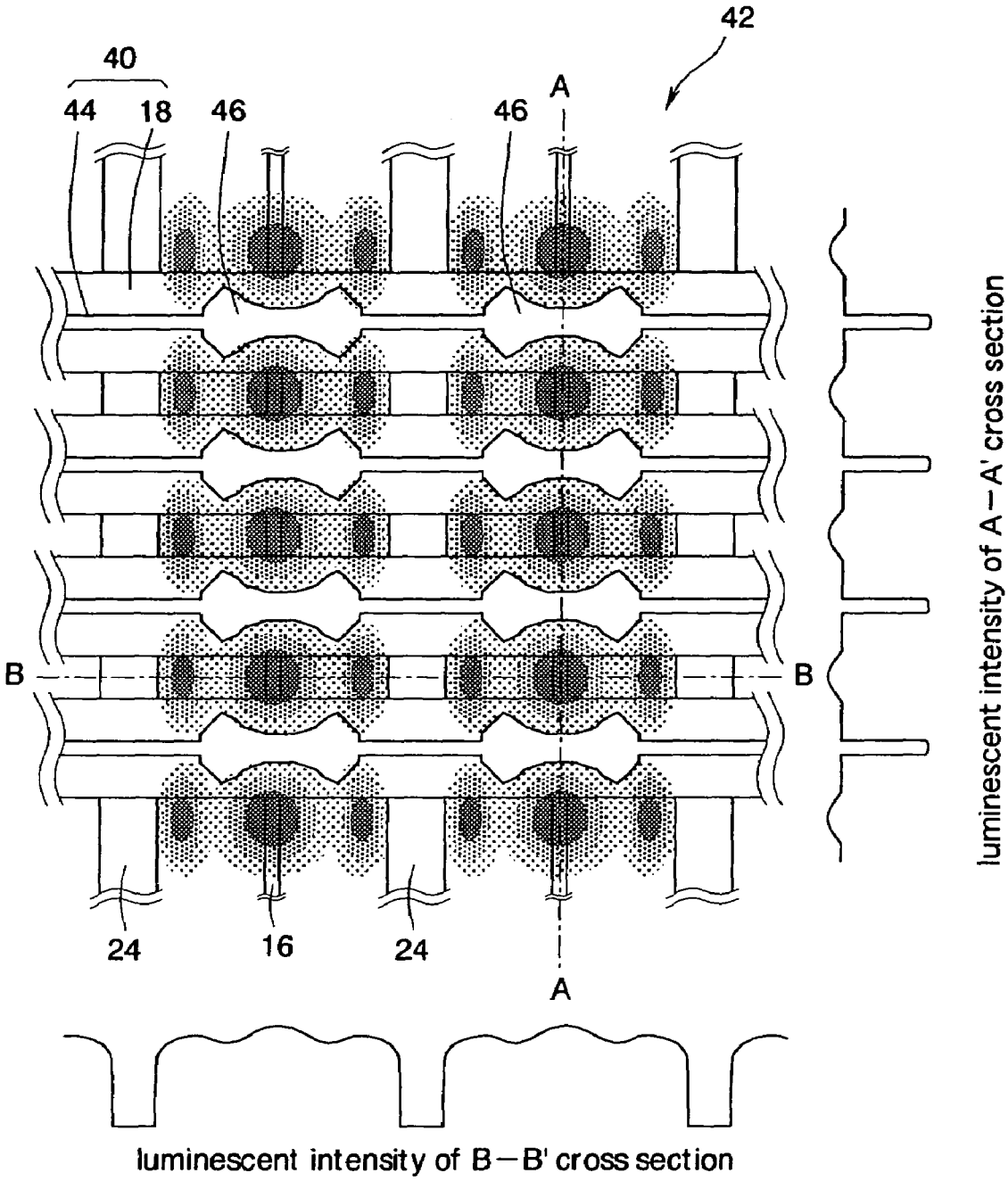
FIG. 9 is an explanatory diagram showing the luminescent intensity distribution on the plasma display panel of FIG. 7.

FIG. 9 shows a luminescent intensity distribution on the PDP 42 of the present embodiment.

In the diagram, darker shadows indicate portions of higher luminescent intensities. That is, the luminescent intensity on the PDP 42 is higher at portions where the transparent electrodes 18 face each other, and near the address electrodes 16 and ribs 24 in particular. The shielding parts 46 in the present embodiment are formed in conformity with the portions of lower luminescent intensities.

Figure 10:
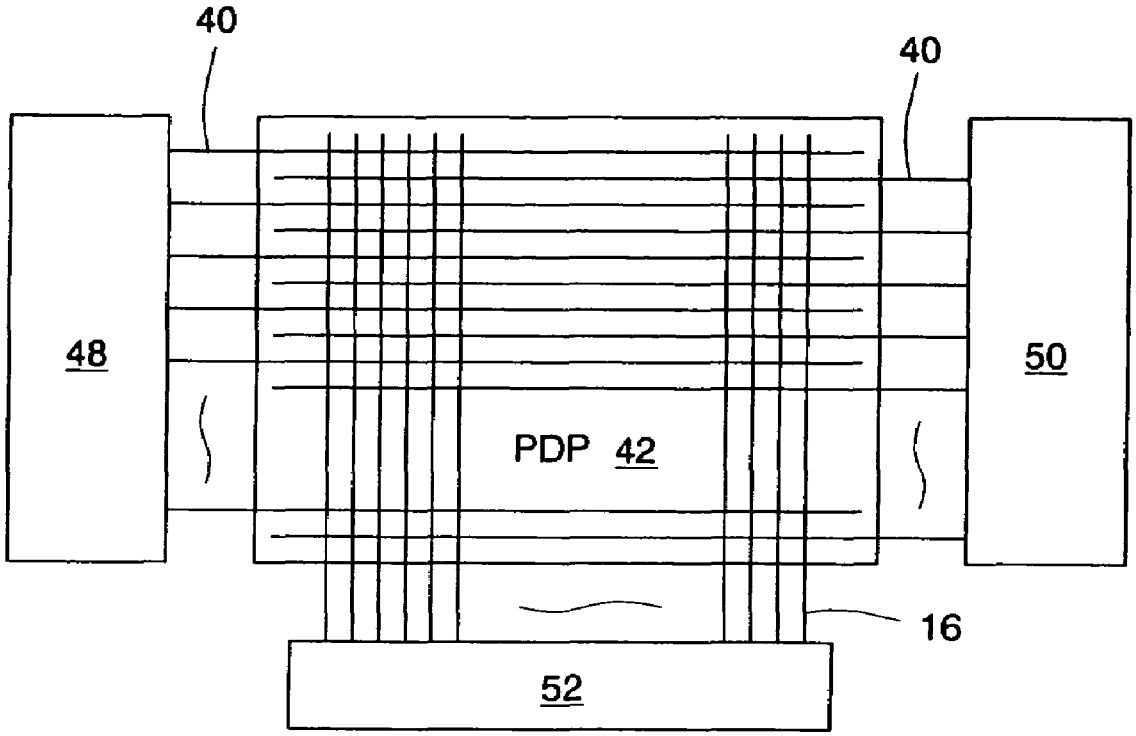
FIG. 10 is a block diagram showing a plasma display apparatus to which the plasma display panel of FIG. 7 is applied.

FIG. 10 shows an example of a plasma display apparatus to which the PDP 42 is applied.

The plasma display apparatus includes a first driving circuit 48 for driving odd-numbered discharge electrodes 40, a second driving circuit 50 for driving even-numbered discharge electrodes 40, and a third driving circuit 52 for driving the address electrodes 16.

As has been described, in the plasma display panel of the present embodiment, the shielding parts 46 shield some of the light incident from exterior. This allows reduction of the surface reflection for an improved bright room contrast ratio. In particular, the bright room contrast ratio can be improved in a PDP of ALIS technology in which discharge can be made with neighboring discharge electrodes on both sides.

The shielding parts 46 are formed in conformity with the portions of lower luminescent intensities. Therefore, the bright room contrast ratio can be improved with a minimum drop in luminescent brightness.

The shielding parts 46 are formed of the same material as that of the bus electrodes 44. Therefore, the shielding parts 46 can be formed simultaneously during the fabrication process of the bus electrodes 44. This prevents the fabrication process from becoming complicated. That is, the shielding parts 46 can be formed simply by changing the mask pattern of the bus electrodes 44, requiring no mask dedicated to the shielding parts 46.

Figure 11:
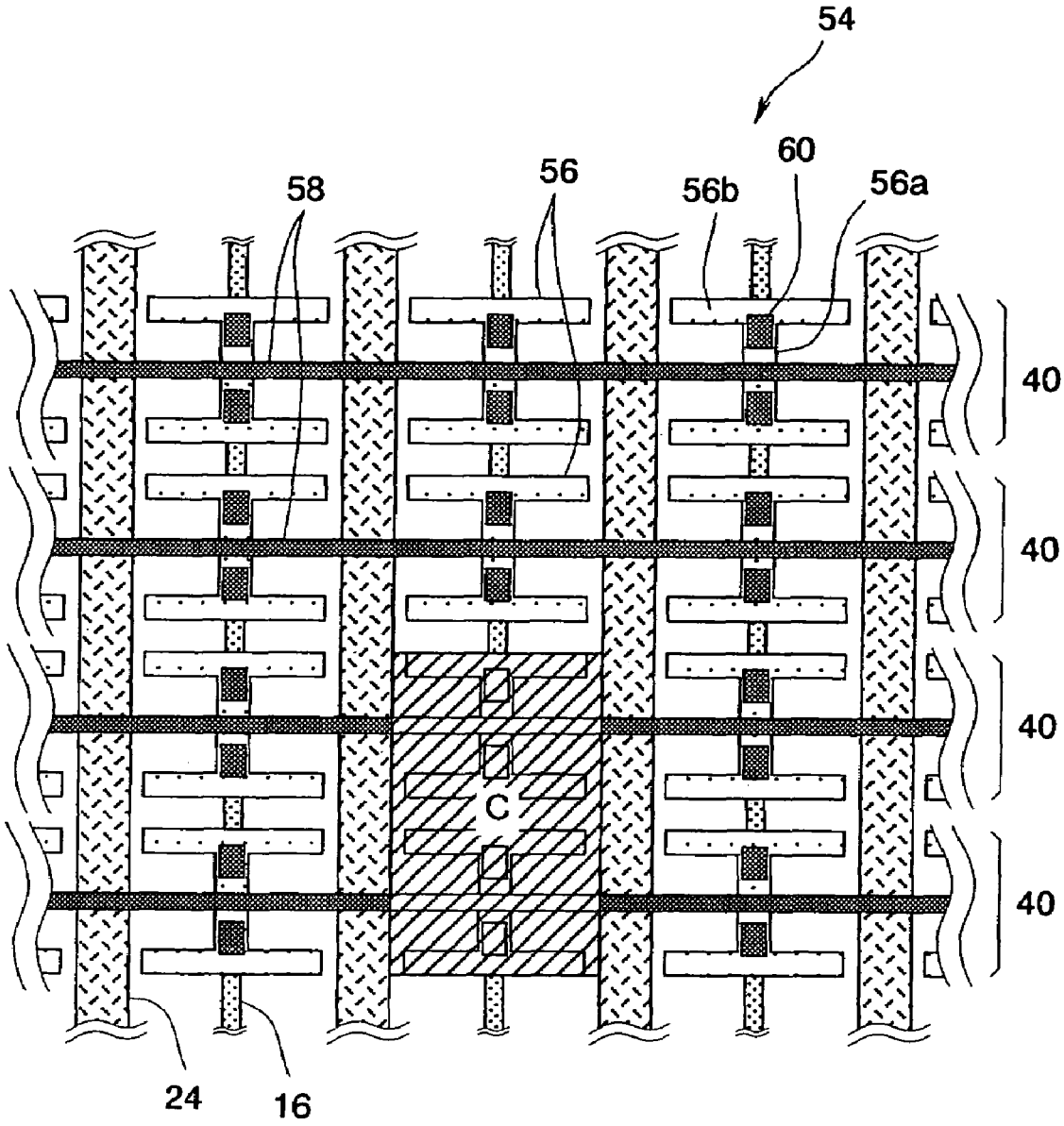
FIG. 11 is a plan view showing the essential parts of a second embodiment of the plasma display panel in the present invention.

FIG. 11 shows the essential parts of a second embodiment of the plasma display panel in the present invention. The same elements as those described in the conventional art and in the first embodiment will be designated by identical reference numbers. Detailed description thereof will be omitted.

This embodiment is formed as a PDP 54 of ALIS technology, and differs from the first embodiment in the configuration of transparent electrodes 56 and in the configuration of bus electrodes 58. The other structure is almost identical to that of the first embodiment.

The transparent electrodes 56 that constitute the discharge electrodes 40 are formed in the same width as that of the bus electrodes 58. In the individual cells C, the transparent electrodes 56 have narrow projecting parts 56*a* which project toward the centers of the cells C. Opposing parts 56*b* lying along the bus electrodes 58 are formed integrally on the tips of the projecting parts 56*a*. That is, the transparent electrodes 56 in the individual cells C are formed in T-shapes facing each other. The T-shape formation of the transparent electrodes 56 reduces the areas of the discharge electrodes 40, and thereby avoids an increase in the discharge current. This consequently avoids a drop in luminous efficiency.

Besides, widening the opposing parts of the transparent electrodes 56 prevents a rise in discharge starting voltage.

Shielding parts 60 are formed on the transparent electrodes 56, extending from the sides of the respective opposing parts 56*b* integral with the tips of the associated projecting parts 56*a*, using the same material as that of the bus electrode 58. The shielding parts 60 are formed at positions of lower luminescent intensities. That is, the shielding parts 60 are formed away from the regions of high luminescent intensity, where the opposing parts 56*b* face of two adjacent discharge electrodes each other and define discharge cell.

This embodiment can offer the same effects as those obtained from the first embodiment described above. Moreover, according to this embodiment, even the PDP 54 with low power consumption and reduced with discharge current can be improved in bright room contrast ratio with a minimum drop in luminescent brightness.

Figure 12:
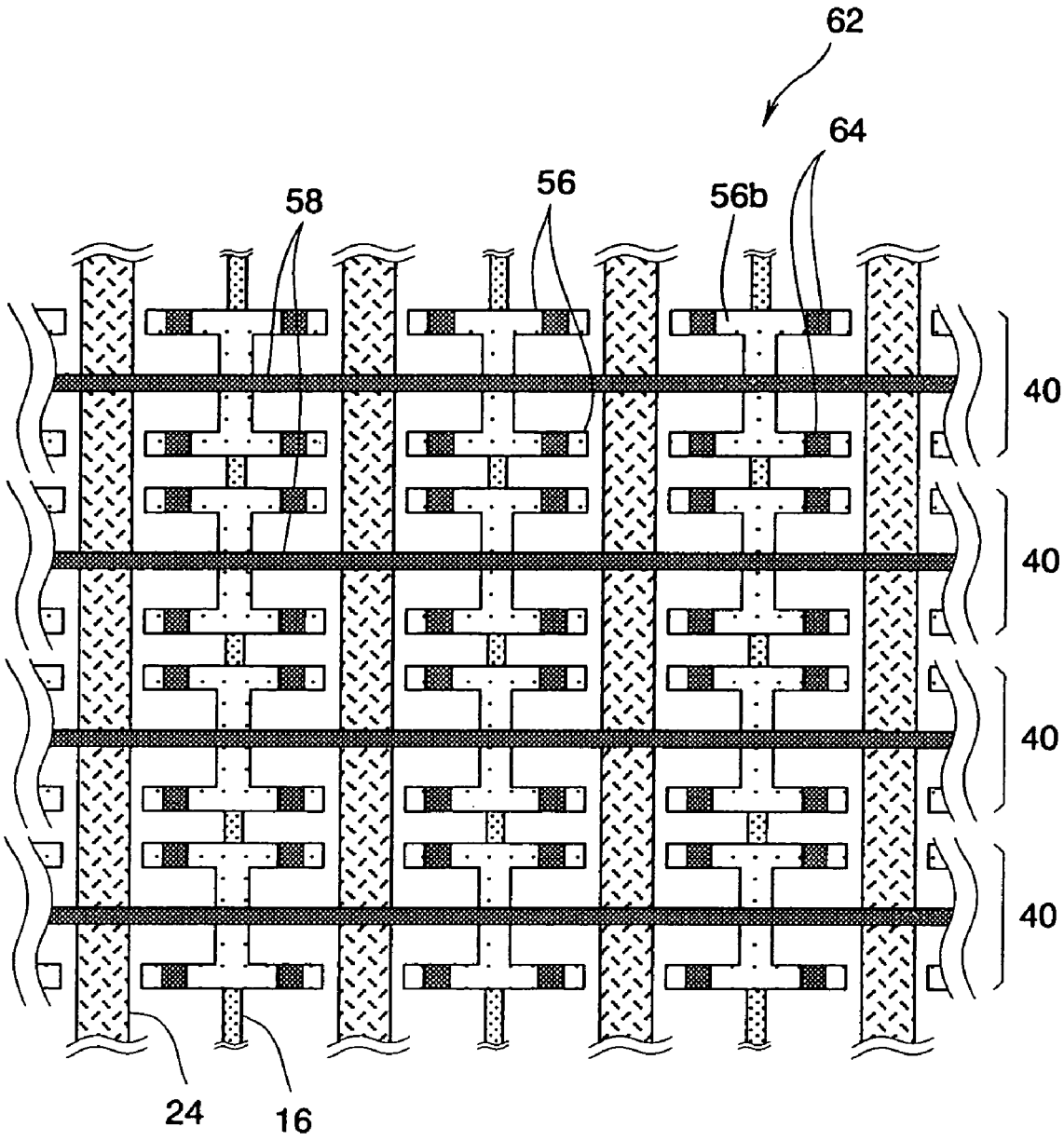
FIG. 12 is a plan view showing the essential parts of a third embodiment of the plasma display panel in the present invention.

FIG. 12 shows the essential parts of a third embodiment of the plasma display panel in the present invention. The same elements as those described in the conventional art and in the second embodiment will be designated by identical reference numbers. Detailed description thereof will be omitted.

This embodiment is formed as a PDP 62 of ALIS technology, and differs from the second embodiment in the configuration and arranged positions of shielding parts 64. The other structure is identical to that of the second embodiment. The shielding parts 64 are formed on the opposing parts 56*b*, between the centers of the opposing parts 56*b* and the ribs 24. That is, the shielding parts 64 are formed away from the regions with high luminescent intensity, where the opposing parts 56*b* face each other.

This embodiment can offer the same effects as those obtained from the second embodiment described above.

Figure 13:
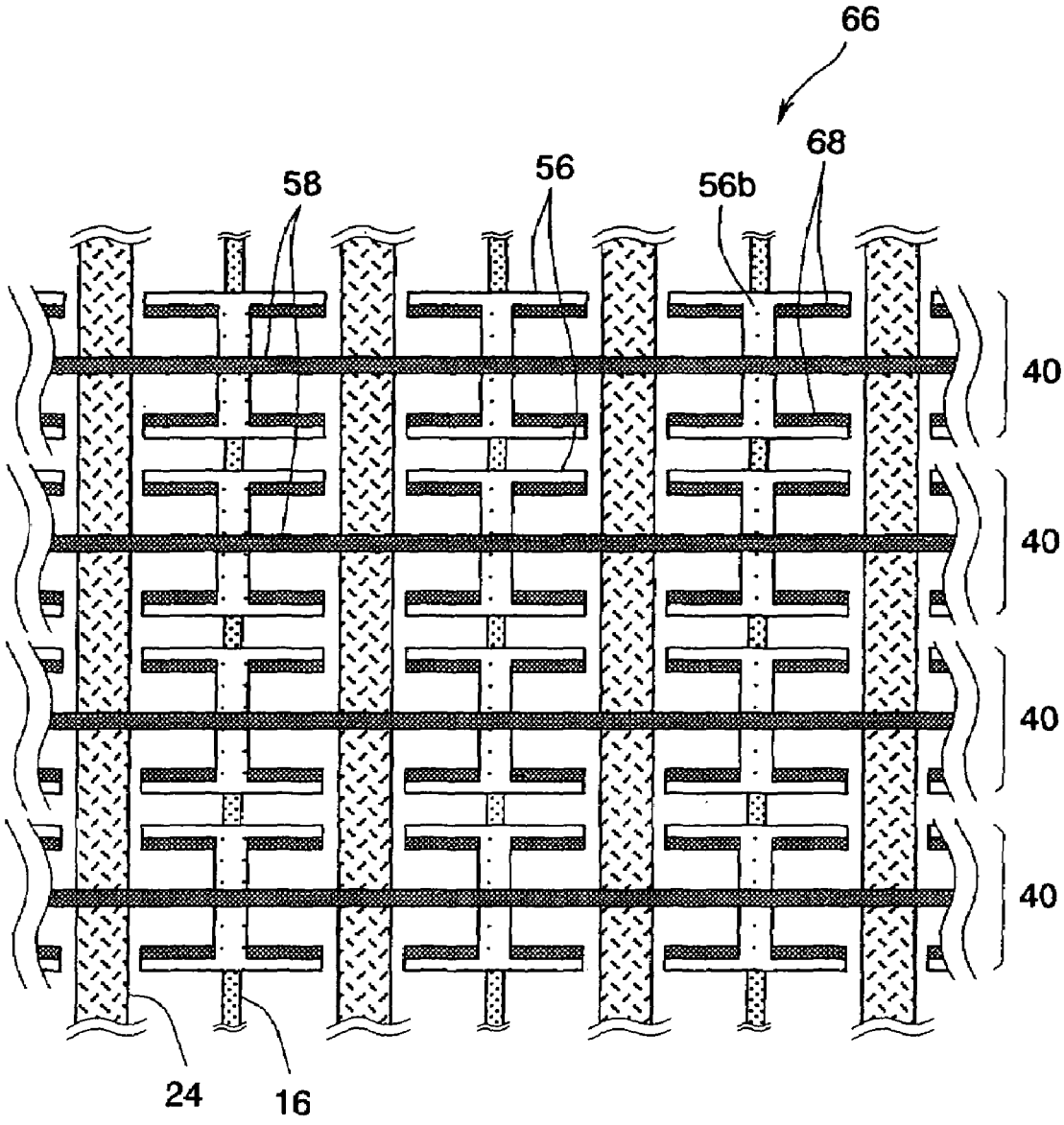
FIG. 13 is a plan view showing the essential parts of a fourth embodiment of the plasma display panel in the present invention.

FIG. 13 shows the essential parts of a fourth embodiment of the plasma display panel in the present invention. The same elements as those described in the conventional art and in the second embodiment will be designated by identical reference numbers. Detailed description thereof will be omitted.

This embodiment is formed as a PDP 66 of ALIS technology, and differs from the second embodiment in the configuration and arranged positions of shielding parts 68. The other structure is identical to that of the second embodiment. The shielding parts 68 are formed on the sides with the bus electrode 58 of the opposing parts 56*b*. That is, the shielding parts 68 are formed at positions away from the regions with high luminescent intensity, where the opposing parts 56*b* face each other.

This embodiment can offer the same effects as those obtained from the second embodiment described above.

Figure 14:
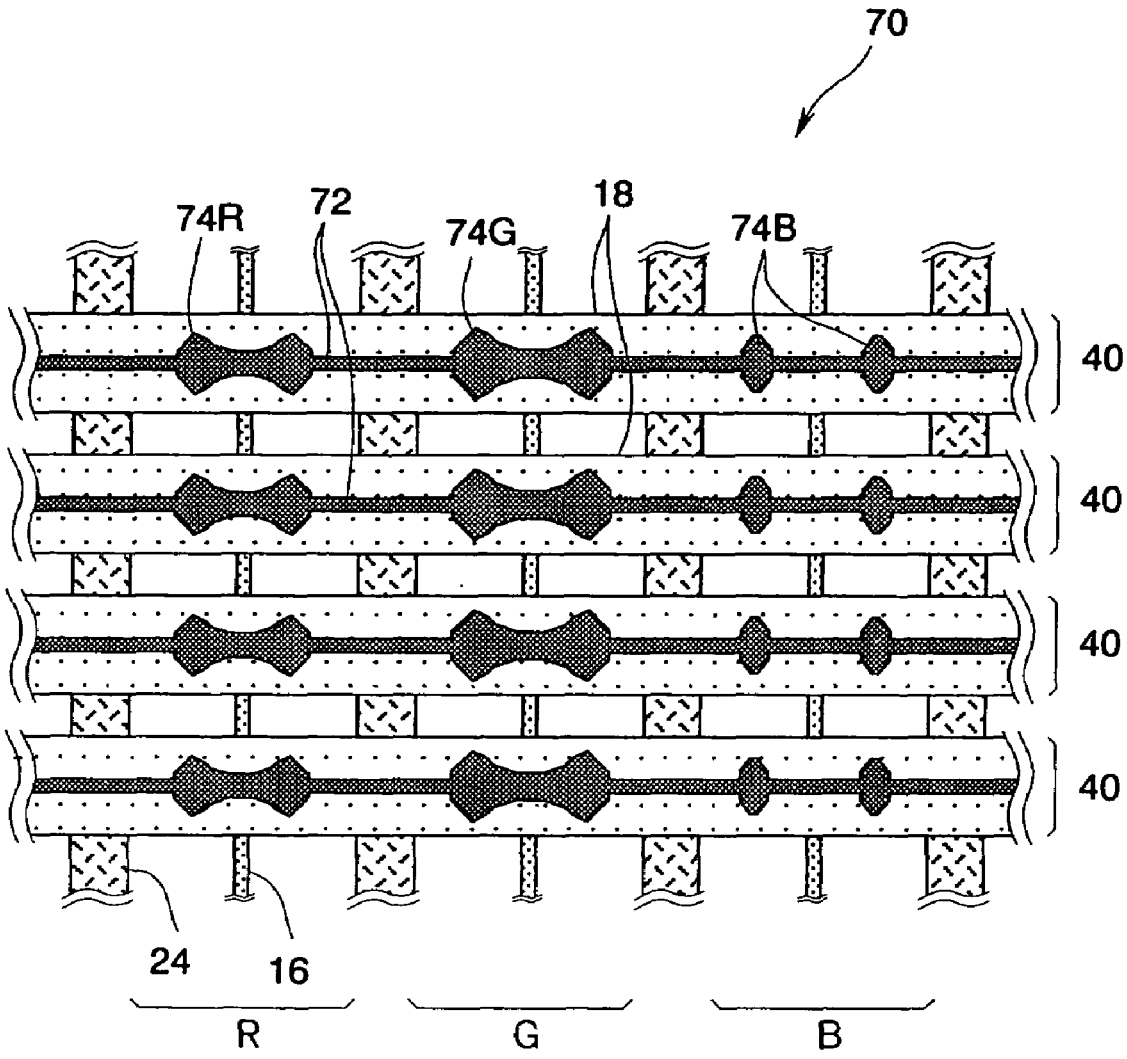
FIG. 14 is a plan view showing the essential parts of a fifth embodiment of the plasma display panel in the present invention.

FIG. 14 shows the essential parts of a fifth embodiment of the plasma display panel in the present invention. The same elements as those described in the conventional art and in the first embodiment will be designated by identical reference numbers. Detailed description thereof will be omitted.

This embodiment is formed as a PDP 70 of ALIS technology. In this PDP 70, shielding parts 74R, 74G, and 74B formed integrally on bus electrodes 72 have different shapes depending on the luminescent colors of the cells C. The other structure is identical to that of the first embodiment. The shielding parts 74B formed in cells C that have a phosphor layer B for emitting blue light are formed smaller than the shielding parts 74R formed in cells C that have a phosphor layer R for emitting red light. The shielding parts 74R are formed smaller than the shielding parts 74G formed in cells C that have a phosphor layer G for emitting green light. That is, the increasing order of the areas of the shielding parts is the shielding parts 74B, the shielding parts 74R, and the shielding parts 74G.

Reducing the area of the shielding parts 74B makes the blue light relatively higher in brightness. This allows an increase of the color temperature in displaying white. Here, the bright room contrast ratio is improved by the shielding parts 74G and 74R of relatively greater areas. The shielding parts 74R, 74G, and 74B are formed in positions of lower luminescent intensities. Therefore, the formation of these shielding parts 74R, 74G, and 74B causes a minimum drop in brightness.

This embodiment can offer the same effects as those obtained from the first embodiment described above. Moreover, in this embodiment, the areas of the shielding parts 74B in cells C emitting blue light are made smaller than the areas of the shielding parts 74R and 74G in cells C emitting red and green light. This can make the blue light relatively higher in brightness. Accordingly, it is possible to increase the white-displaying color temperature while improving the bright room contrast ratio.

Figure 15:
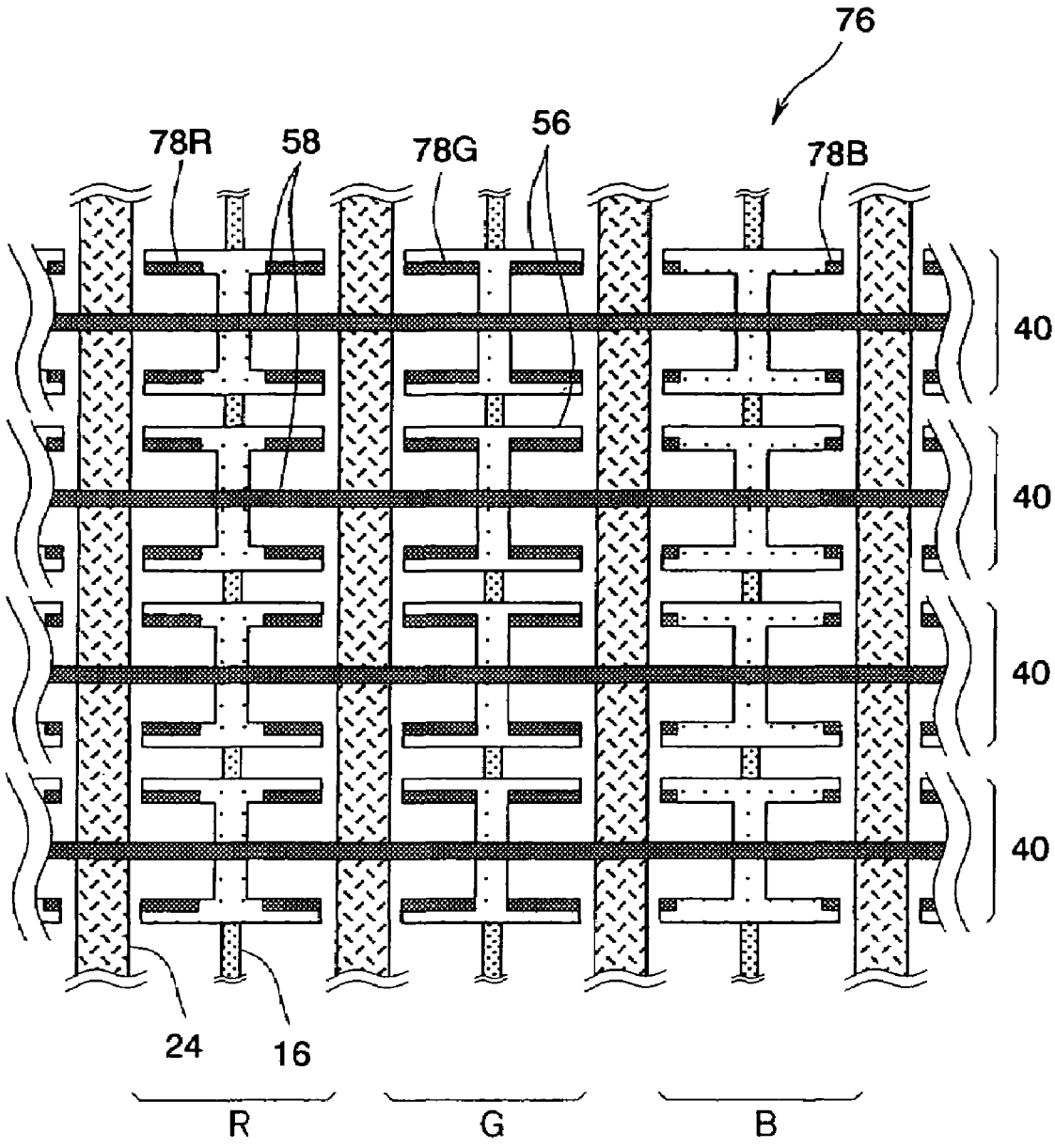
FIG. 15 is a plan view showing the essential parts of a sixth embodiment of the plasma display panel in the present invention.

FIG. 15 shows the essential parts of a sixth embodiment of the plasma display panel in the present invention. The same elements as those described in the conventional art and in the fourth embodiment will be designated by identical reference numbers. Detailed description thereof will be omitted.

This embodiment is formed as a PDP 76 of ALIS technology having the T-shaped transparent electrodes 56, in which shielding parts 78R, 78G, and 78R have different areas depending the luminescent colors of the cells C. The other structure is identical to that of the fourth embodiment. As in the fifth embodiment, the increasing order of the areas of the shielding parts is the shielding parts 78B formed in the cells C having the phosphor layer B, the shielding parts 78R formed in the cells C having the phosphor layer R, and the shielding parts 78G formed in the cells C having the phosphor layer G. The shielding parts 78R, 78G, and 78B are formed in positions of lower luminescent brightness, thereby minimizing the drop in brightness.

This embodiment can offer the same effects as those obtained from the fifth embodiment described above.

Figure 16:
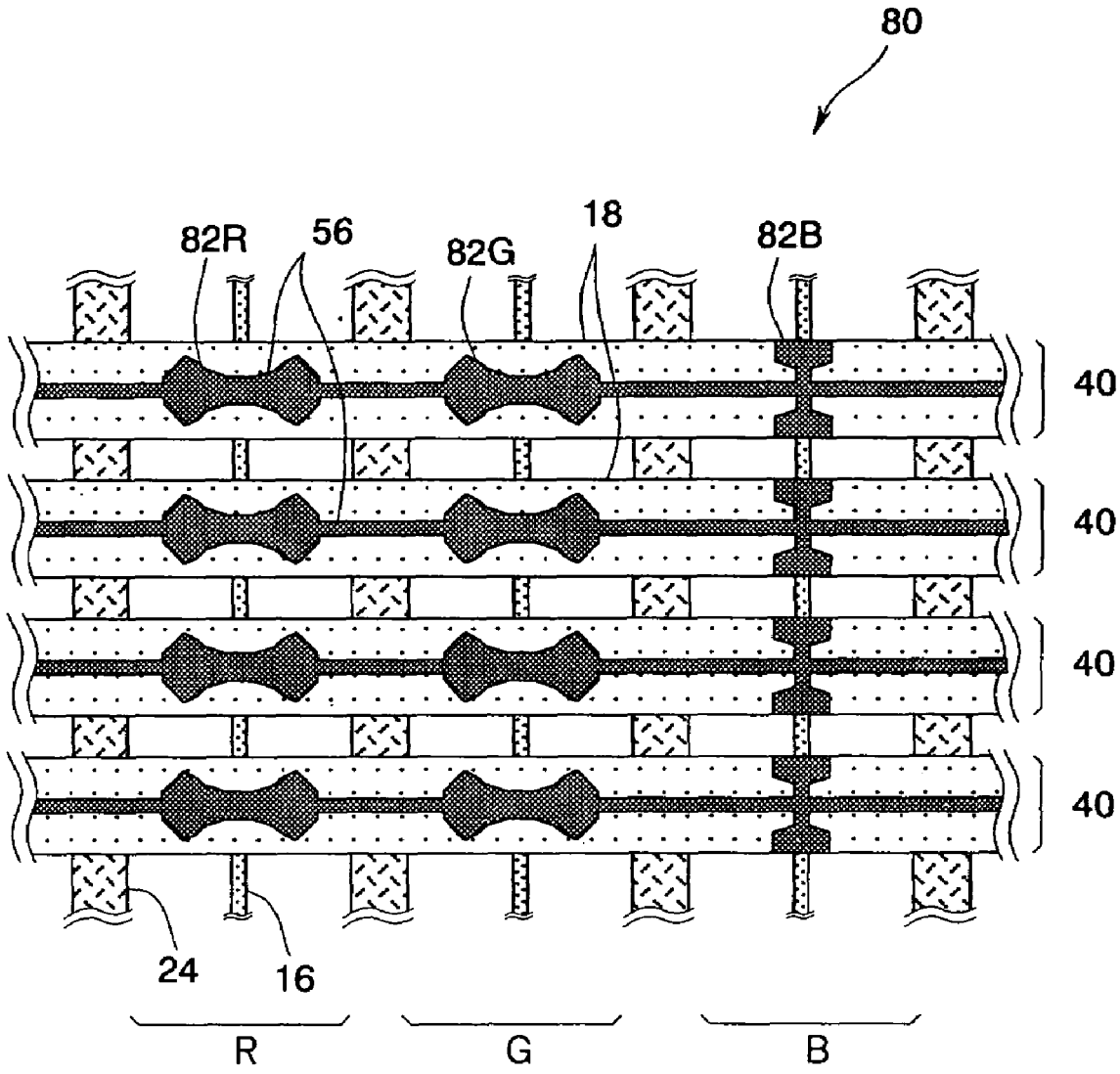
FIG. 16 is a plan view showing the essential parts of a seventh embodiment of the plasma display panel in the present invention.

FIG. 16 shows the essential parts of a seventh embodiment of the plasma display panel in the present invention. The same elements as those described in the conventional art and in the first embodiment will be designated by identical reference numbers. Detailed description thereof will be omitted.

This embodiment is formed as a PDP 80 of ALIS technology. Shielding parts 82R formed in the cells C that have the phosphor layer R and shielding parts 82G formed in the cells C that have the phosphor layer G are formed in the same shapes and positions as those of the shielding parts 46 in the first embodiment described above while shielding parts 82B formed in the cells C that have the phosphor layer B are formed in conformity with discharging portions. That is, the shielding parts 82B are formed in conformity with portions of higher luminescent brightness. In general, when the gas in the discharge space 28 contains neon (Ne), discharging portions produce not only ultraviolet rays but also visible light resulting from neon discharge. In the cells that emit blue light, this visible light makes the blue light look reddish, with a drop in blue color purity. The formation of the shielding parts 82B in conformity with discharging portions in the cells emitting blue light prevents the external radiation of the visible light caused by neon discharge, thereby avoiding the drop in blue color purity. Here, the bright room contrast ratio is improved by the shielding parts 82G and 82R of relatively greater areas.

This embodiment can offer the same effects as those obtained from the second embodiment described above. Moreover, in this embodiment, the shielding parts 82*b* in the cells emitting blue light block the external radiation of the visible light caused by neon discharge and the like. This can avoid a drop in the color purity of the blue light.

Figure 17:
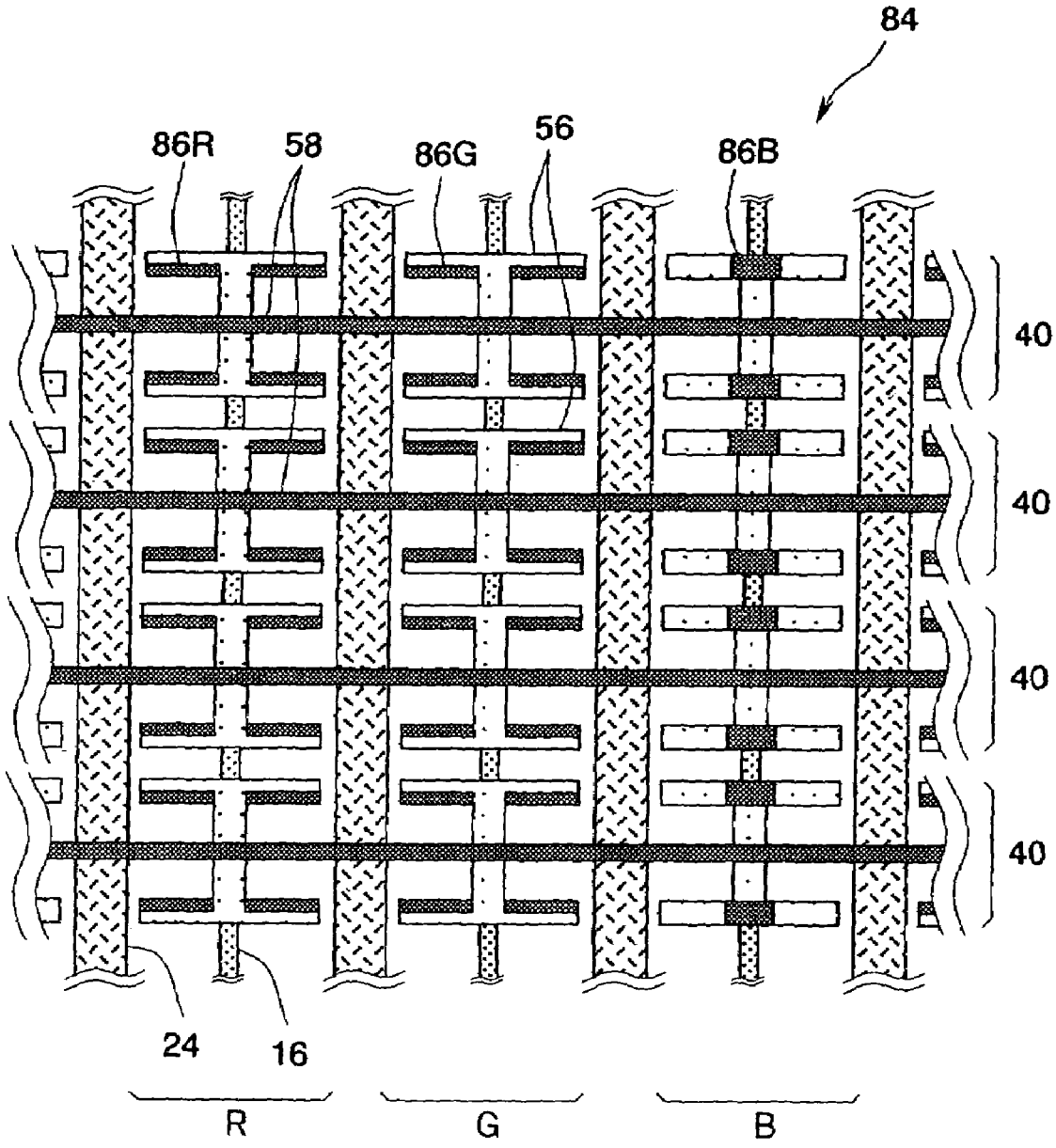
FIG. 17 is a plan view showing the essential parts of an eighth embodiment of the plasma display panel in the present invention.

FIG. 17 shows the essential parts of an eighth embodiment of the plasma display panel in the present invention. The same elements as those described in the conventional art and in the fourth embodiment will be designated by identical reference numbers. Detailed description thereof will be omitted.

This embodiment is formed as a PDP 84 of ALIS technology. Shielding parts 86R formed in the cells C that have the phosphor layer R and shielding parts 86G formed in the cells C that have the phosphor layer G are formed in the same sizes and positions as those of the shielding parts 68 in the fourth embodiment described above while shielding parts 86B formed in the cells C that have the phosphor layer B are formed in conformity with discharging portions. That is, the shielding parts 86B are formed in conformity with portions of higher luminescent brightness, thereby avoiding the external radiation of the visible light caused by neon discharge.

This embodiment can offer the same effects as those obtained from the seventh embodiment described above.

Figure 1:
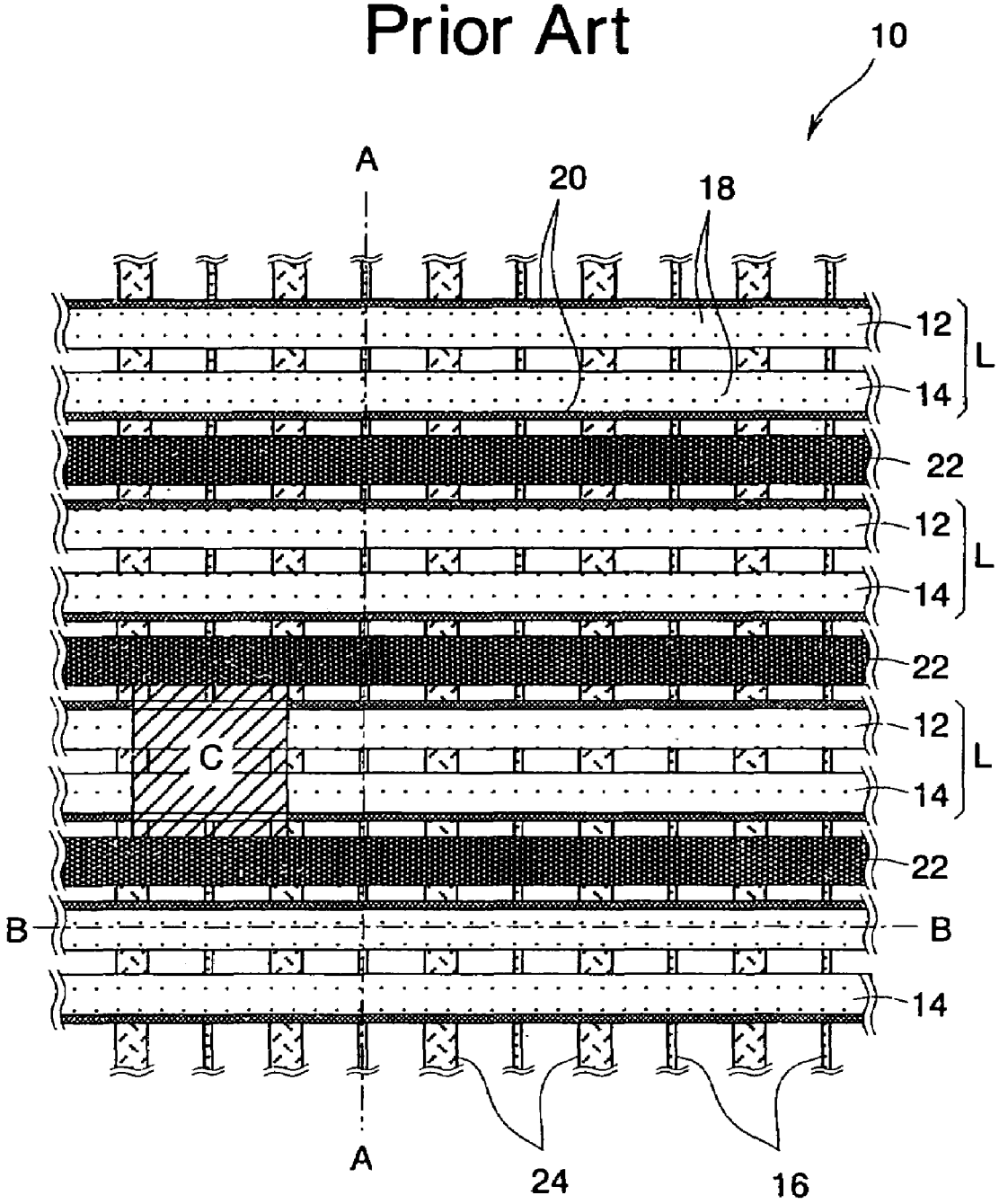
FIG. 1 is a plan view showing an overview of a conventional plasma display panel of surface-discharge alternating-current type.
Figure 2:
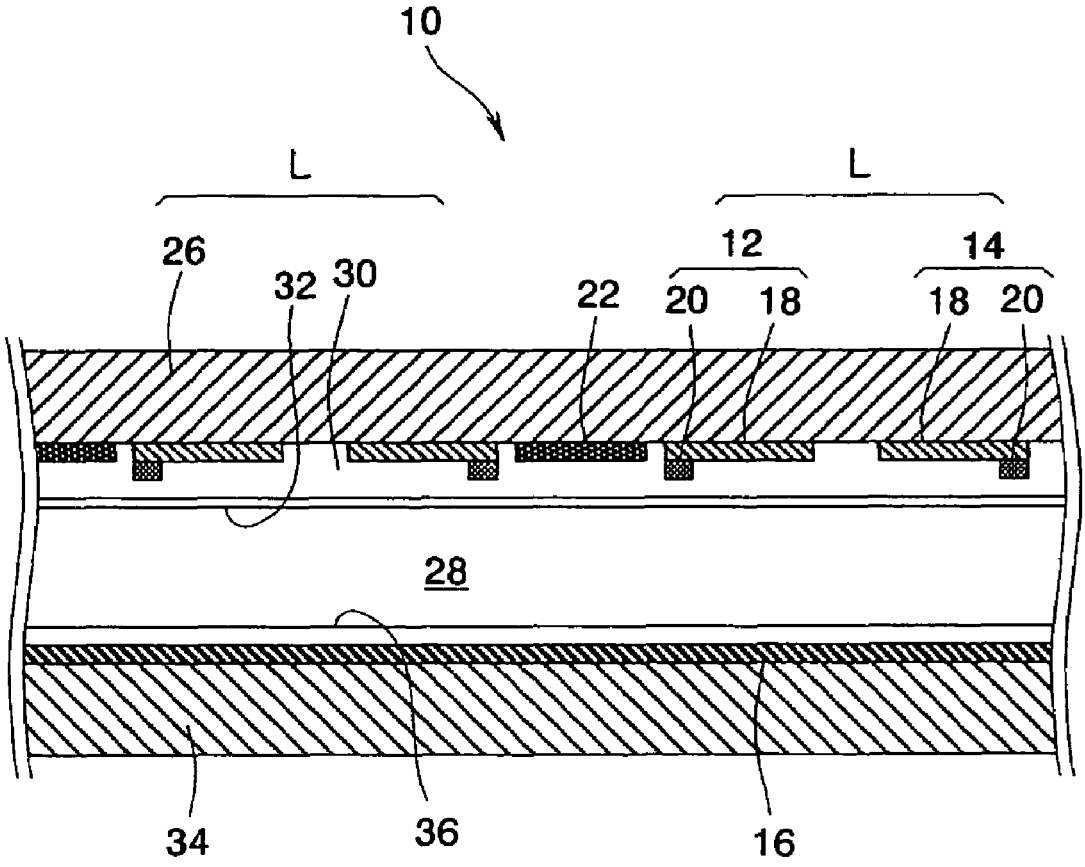
FIG. 2 is a cross-sectional view along the line A—A of FIG. 1.
Figure 3:
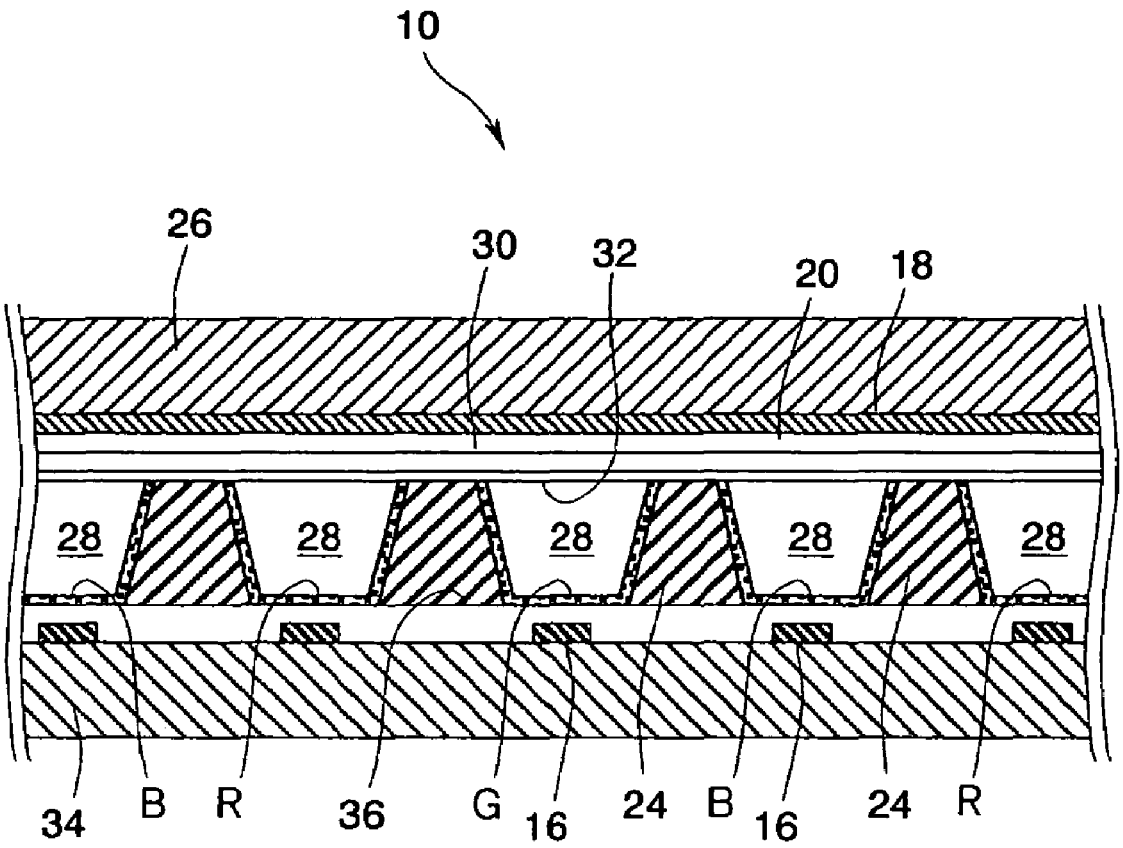
FIG. 3 is a cross-sectional view along the line B—B of FIG. 1.

Now, the embodiments described above have dealt with the cases where the present invention is applied to a PDP of ALIS technology. However, the present invention is not limited to such embodiments. For example, the present invention may be applied to a PDP in which sustain discharge is created between a pair of discharge electrodes alone (such as a PDP having the black stripe 22 shown in FIG. 1).

The second embodiment described above has dealt with the case where the shielding parts 60 are formed apart from the bus electrodes 58. However, the present invention is not limited to such an embodiment. For example, the shielding parts may be formed integral with the bus electrodes 58.

The second embodiment described above has dealt with the case where the shielding parts are formed of the same material as that of the bus electrodes. However, the present invention is not limited to such an embodiment. For example, the shielding parts may be formed of material different from that of the bus electrodes. Here, insulators may be used to form the shielding parts on portions other than where they face the transparent electrodes.

The invention is not limited to the above embodiments and various modifications may be made without departing from the spirit and scope of the invention. Any improvement may be made in part or all of the components.

What is claimed is:

1. A plasma display panel, comprising:

a plurality of discharge electrodes arranged on an interior main surface of a front substrate, an exterior main surface thereof comprising a display surface, each of said discharge electrodes comprising a bus electrode and a transparent electrode connected to said bus electrode and extending in a longitudinal direction, opposing portions of adjacent discharge electrodes, spaced in a lateral direction, defining corresponding discharge cells; and shielding parts, each extending at least in part over a respective discharge cell, to shield light from an exterior of the front substrate, which is incident on the shielding part, from entering the respective discharge cell, each shielding part formed on a corresponding said transparent electrode and disposed laterally of the corresponding bus electrode.

2. The plasma display panel according to claim 1, wherein said shielding parts are formed within the cells, other than between the corresponding, opposing portions of adjacent discharge electrodes defining respective cells, in conformity with portions having low luminescent intensity.

3. The plasma display panel according to claim 1, wherein said shielding parts are formed of the same material as that of said bus electrodes.

4. A plasma display panel, comprising:

a plurality of discharge electrodes arranged on an interior main surface of a front substrate, an exterior main surface thereof comprising a side of a display surface, each of said discharge electrodes having a bus electrode and a transparent electrode connected to said bus electrode and extending in a longitudinal direction, opposing portions of adjacent discharge electrodes, spaced in a lateral direction, defining corresponding discharge cells;

shielding parts to shield incident light from an exterior of the front substrate, each shielding part formed on a corresponding said transparent electrode and disposed laterally of and not connected to the corresponding bus electrode;

a rear substrate having an interior main surface facing the interior main surface of said front substrate, with a discharge space therebetween;

a plurality of address electrodes parallel to each other, and extending along said rear substrate in a direction orthogonal to said discharge electrodes; cells, in which light is emitted, wherein:

each cell includes narrow projecting transparent electrode parts projecting laterally toward the center of the cell and having respective, opposing parts at tips of said projecting parts extending longitudinally, and each shielding part extending at least in part over a respective discharge cell to shield light from an exterior of the front substrate, which is incident on the shielding part, from entering the respective discharge cell.

5. The plasma display panel according to claim 4, wherein each of said opposing parts are wider than each of said projecting parts.

6. A plasma display panel, comprising:

a plurality of discharge electrodes arranged on an interior main surface of a front substrate, an exterior main surface thereof comprising a side of a display surface, each of said discharge electrodes having a bus electrode and a transparent electrode connected to said bus electrode and extending in a longitudinal direction, opposing portions of adjacent discharge electrodes, spaced in a lateral direction, defining corresponding discharge cells;

shielding parts to shield incident light from an exterior of the front substrate, each shielding part formed on a corresponding said transparent electrode and disposed laterally of the corresponding bus electrode;

a rear substrate having an interior main surface facing the interior main surface of said front substrate, with a discharge space therebetween;

a plurality of address electrodes parallel to each other, and extending along said rear substrate in a direction orthogonal to said discharge electrodes; and cells, in which light is emitted, wherein:

each cell includes narrow projecting transparent electrode parts projecting laterally toward the center of the cell and having respective, opposing parts at tips of said projecting parts extending longitudinally, said shielding parts are formed on the surfaces of said projecting parts and of connections thereof to the respective opposing parts, in correspondence to regions having lower luminescent intensity relatively to regions having higher luminescent intensity; and each shielding part extending at least in part over a respective discharge cell to shield light from an exterior of the front substrate, which is incident on the shielding part, from entering the respective discharge cell.

7. The plasma display panel according to claim 6, further comprising a rib formed along spaces between said address electrodes wherein said shielding parts are formed on said opposing parts, each of the shielding parts formed between said rib and the center of said opposing part.

8. The plasma display panel according to claim 6, wherein said shielding parts are formed on said opposing parts, at the sides closer to said bus electrodes.

9. A plasma display panel, comprising:

a plurality of discharge electrodes arranged on an interior main surface of a front substrate, an exterior main surface thereof comprising a display surface, each of said discharge electrodes comprising a bus electrode and a transparent electrode connected to said bus electrode and extending in a longitudinal direction, opposing portions of adjacent discharge electrodes, spaced in a lateral direction, defining corresponding discharge cells; and shielding parts to shield incident light from an exterior of the front substrate, each shielding part formed on a corresponding said transparent electrode and disposed laterally of the corresponding bus electrode, wherein:

a plurality of cells, which are units discharge-generated light is emitted in, are formed along said discharge electrodes neighboring each other, said shielding parts formed respectively in said cells have different areas, depending on the luminescent colors of said cells, and each shielding part extending at least in part over a respective discharge cell to shield light from an exterior of the front substrate, which is incident on the shielding part, from entering the respective discharge cell.

10. The plasma display panel according to claim 9, wherein:

said cells include blue cells for emitting blue light; and said shielding part formed in each of said blue cells have an area smaller than areas of said shielding parts formed in other cells.

11. A plasma display panel, comprising:

a plurality of discharge electrodes arranged on an interior main surface of a front substrate, an exterior main surface thereof comprising a display surface, each of said discharge electrodes comprising a bus electrode and a transparent electrode connected to said bus electrode and extending in a longitudinal direction, opposing portions of adjacent discharge electrodes, spaced in a lateral direction, defining corresponding discharge cells; and shielding parts to shield incident light from an exterior of the front substrate, each shielding part formed on a corresponding said transparent electrode and disposed laterally of the corresponding bus electrode, wherein:

a plurality of cells of respective and different, plural colors of light emission define a single pixel, each pixel including a cell emitting blue light and other cells emitting other color lights;

said shielding part in said blue cells of each pixel is of a smaller area than the respective shielding parts in the other color cells of the pixel; and said respective shielding parts in said cells of each pixel are formed in correspondence to regions of low intensity, each shielding part extending at least in part over a respective discharge cell to shield light from an exterior of the front substrate, which is incident on the shielding part, from entering the respective discharge cell.

12. A plasma display panel, comprising:

a plurality of discharge electrodes arranged on an interior main surface of a front substrate, an exterior main surface thereof comprising a display surface, each of said discharge electrodes having a bus electrode and a transparent electrode connected to said bus electrode and extending in a longitudinal direction, opposing portions of adjacent discharge electrodes, spaced in a lateral direction, defining corresponding discharge cells, each said discharge electrode being capable of discharging, alternately, with each of the adjacent electrodes; and shielding parts formed along said front substrate and disposed laterally of and connected to the corresponding bus electrode, each shielding part extending at least in part over a respective discharge cell to shield light from an exterior of the front substrate, which is incident on the shielding part, from entering the respective discharge cell.

13. The plasma display panel according to claim 12, wherein said shielding parts are formed within the cells, other than between the corresponding, opposing portions of adjacent discharge electrodes defining respective cells, in conformity with portions having low luminescent intensity.

14. The plasma display panel according to claim 12, wherein said shielding parts are formed of the same material as that of said bus electrodes.

15. A plasma display panel, comprising:

a plurality of discharge electrodes arranged on an interior main surface of a front substrate, an exterior main surface thereof comprising a side of a display surface, each of said discharge electrodes having a bus electrode and a transparent electrode connected to said bus electrode and extending in a longitudinal direction, opposing portions of adjacent discharge electrodes, spaced in a lateral direction, defining corresponding discharge cells, each said discharge electrode being capable of discharging, alternately, with each of the adjacent electrodes;

shielding parts to shield incident light from an exterior of the front substrate, each shielding part formed on a corresponding said transparent electrode and disposed laterally of and not connected to the corresponding bus electrode;

a rear substrate facing said front substrate, with a discharge space in between;

a plurality of address electrodes parallel to each other, and placed along said rear substrate in a direction orthogonal to said discharge electrodes;

cells in which light is emitted, wherein each cell includes narrow projecting transparent electrode parts projecting laterally toward the center of the cell and having respective, opposing parts at tips of said projecting parts extending longitudinally;

said shielding parts are formed on at least one of said projecting parts and said opposing parts, in correspondence to regions having lower luminescent intensity relatively to each region having higher luminescent intensity; and each shielding part extending at least in part over a respective discharge cell to shield light from an exterior of the front substrate, which is incident on the shielding part, from entering the respective discharge cell.

16. The plasma display panel according to claim 15, further comprising a rib formed along spaces between said address electrodes wherein said shielding parts are formed on said opposing parts, each of the shielding parts formed between said rib and the center of said opposing part.

17. The plasma display panel according to claim 15, wherein said shielding parts are formed on said opposing parts, at the sides closer to said bus electrodes.

18. The plasma display panel according to claim 15, wherein each of said opposing parts are wider than each of said projecting parts.

19. A plasma display panel, comprising:

a plurality of discharge electrodes arranged on an interior main surface of a front substrate, an exterior main surface thereof comprising a side of a display surface, each of said discharge electrodes having a bus electrode and a transparent electrode connected to said bus electrode and extending in a longitudinal direction, opposing portions of adjacent discharge electrodes, spaced in a lateral direction, defining corresponding discharge cells;

shielding parts to shield incident light from an exterior of the front substrate, each shielding part formed on a corresponding said transparent electrode and disposed laterally of the corresponding bus electrode;

a rear substrate facing said front substrate, with a discharge space in between;

a plurality of address electrodes parallel to each other, and placed along said rear substrate in a direction orthogonal to said discharge electrodes; and cells in which light is emitted, wherein each cell includes narrow projecting transparent electrode parts projecting laterally toward the center of the cell and having respective, opposing parts at tips of said projecting parts extending longitudinally, wherein:

said shielding parts are formed on the surfaces of said projecting parts and of connections thereof to the respective opposing parts, in correspondence to regions having lower luminescent intensity relatively to each region having higher luminescent intensity; and each shielding part extending at least in part over a respective discharge cell to shield light from an exterior of the front substrate, which is incident on the shielding part, from entering the respective discharge cell.

20. A plasma display panel, comprising:

a plurality of discharge electrodes arranged on an interior main surface of a front substrate, an exterior main surface thereof comprising a display surface, each of said discharge electrodes having a bus electrode and a transparent electrode connected to said bus electrode and extending in a longitudinal direction, opposing portions of adjacent discharge electrodes, spaced in a lateral direction, defining corresponding discharge cells, each said discharge electrode being capable of discharging, alternately, with each of the adjacent electrodes; and shielding parts to shield incident light from an exterior of the front substrate, each shielding part formed along said front substrate, and disposed laterally of the corresponding bus electrode, wherein:

a plurality of cells, which are units discharge-generated light is emitted in, are formed along said discharge electrodes neighboring each other;

said shielding parts formed respectively in said cells have different areas, depending on the luminescent colors of said cells; and each shielding part extending at least in part over a respective discharge cell to shield light from an exterior of the front substrate, which is incident on the shielding part, from entering the respective discharge cell.

21. The plasma display panel according to claim 20, wherein:

said cells include blue cells for emitting blue light; and said shielding part formed in each of said blue cells have an area smaller than areas of said shielding parts formed in other cells.

22. A plasma display panel, comprising:

a plurality of discharge electrodes arranged on an interior main surface of a front substrate, an exterior main surface thereof comprising a display surface, each of said discharge electrodes having a bus electrode and a transparent electrode connected to said bus electrode and extending in a longitudinal direction, opposing portions of adjacent discharge electrodes, spaced in a lateral direction, defining corresponding discharge cells, each said discharge electrode being capable of discharging, alternately, with each of the adjacent electrodes; and shielding parts to shield incident light from an exterior of the front substrate, each shielding part formed along said front substrate and disposed laterally of the corresponding bus electrode, wherein:

a plurality of cells of respective and different, plural colors of light emission define a single pixel, each pixel including a cell emitting blue light and other cells emitting other color lights;

said shielding part in said blue cells of each pixel being of a smaller area than the respective shielding parts in the other color cells of the pixel; and said respective shielding parts in said cell of each pixel are formed in correspondence to regions of low intensity, each shielding part extending at least in part over a respective discharge cell to shield light from an exterior of the front substrate, which is incident on the shielding part, from entering the respective discharge cell.

23. A plasma display panel, comprising:

a plurality of discharge electrodes arranged on an interior main surface of a front substrate, an exterior main surface thereof comprising a display surface, each of said discharge electrodes comprising a bus electrode and a transparent electrode connected to said bus electrode and extending in a longitudinal direction, opposing portions of adjacent discharge electrodes, spaced in a lateral direction, defining corresponding discharge cells; and plural shielding parts, spaced longitudinally along the bus electrode in alignment with respective discharge cells and of increased lateral dimensions, relatively to a lateral dimension of the corresponding bus electrode, so as to extend over corresponding portions of the respective discharge cells and each shielding part shielding light from an exterior of the front substrate which is incident on the shielding part, from entering the respective discharge cell.

24. The plasma display panel according to claim 23, wherein plural said shielding parts are formed in longitudinally spaced relationship, alternating with aligned portions of a respective bus electrode, the aligned bus electrode portions integrally nterconnecting respective, spaced shielding parts.

25. A plasma display panel, comprising:

front and rear substrates having opposing, interior surfaces spaced to define a discharge gap therebetween and an exterior surface of the front substrate defining a display surface;

a plurality of discharge electrodes arranged on the interior surface of the front substrate, each discharge electrode comprising a bus electrode and a transparent electrode connected to the bus electrode, adjacent, opposed portions of the transparent electrodes defining corresponding discharge cells that are spaced in the longitudinal direction;

each discharge cell having at least one region of highest luminescent intensity in the vicinity of the opposing portions of the transparent, opposed electrodes and regions of relatively lower luminescent intensity within each discharge cell; and a shielding part disposed on the transparent electrode in each respective discharge cell and disposed laterally of and not connected to the corresponding bus electrode, to shield light from the exterior of the panel which is incident on the shielding part, from entering the respective cell in at least a selected said region thereof of relatively lower luminescent intensity.

26. A plasma display panel, comprising:

front and rear substrates having opposing, interior surfaces spaced to define a discharge gap therebetween and an exterior surface of the front substrate defining a display surface;

a plurality of discharge electrodes arranged on the interior surface of the front substrate, each discharge electrode comprising a bus electrode and a transparent electrode connected to the bus electrode, adjacent, opposed portions of the transparent electrodes defining corresponding discharge cells that are spaced in the longitudinal direction;

each discharge cell having at least one region of higher luminescent intensity in the vicinity of the opposing portions of the transparent, opposed electrodes and regions of relatively lower luminescent intensity within each cell; and a shield part disposed on the transparent electrode in each cell and disposed laterally of the corresponding bus electrode, each shielding part extending at least in part over a respective discharge cell to shield light from an exterior of the front substrate, which is incident on the shielding part, from entering the respective discharge cell in at least a selected said region of relatively lower luminescent intensity;

wherein the transparent electrodes further comprise:

a projecting, narrow part extending laterally from the bus electrode;

an opposing part integrally formed with the narrow projecting part at a tip thereof and extending longitudinally, parallel to the bus electrode; and in each said cell, the shielding part is formed on at least the projecting, narrow part.

27. A plasma display panel, comprising:

a plurality of discharge electrodes arranged on an interior main surface of a front substrate, an exterior main surface of the front substrate comprising a display surface, each of said discharge electrodes comprising a bus electrode and a transparent electrode, connected to said bus electrode commonly extending therewith in a longitudinal direction, adjacent discharge electrodes having parallel, continuous edges in spaced relationship and opposing, longitudinally spaced portions of the edges being aligned with corresponding discharge cells, each discharge cell having first regions of higher, generally common luminescent intensities and second regions of lower luminescent intensities; and shielding parts to shield light from an exterior of the front substrate and incident on the shielding parts from entering the respective discharge cells, each shielding part being formed on a corresponding said transparent electrode in association with the corresponding discharge cell and enlarged in the lateral direction, relatively to the corresponding bus electrode, so as to overlie the second regions of lower luminescent intensity, and having an edge of a configuration corresponding to a border between the first and second regions, respectively of the higher and the lower luminescent intensities.

28. The plasma display panel according to claim 27, wherein said shielding parts are formed in longitudinally spaced relationship, alternating with aligned portions of a respective bus electrode, the aligned portions integrally interconnecting the spaced shielding parts.

29. A plasma display panel, comprising:

a plurality of discharge electrodes arranged on an interior main surface of a front substrate, an exterior main surface thereof comprising a display surface, each of said discharge electrodes comprising a bus electrode and a transparent electrode connected to said bus electrode and extending in a longitudinal direction, opposing portions of adjacent discharge electrodes, spaced in a lateral direction, defining corresponding discharge cells, discharges being produced in each discharge cell generating light in a pattern of differing luminescent intensities comprising at least first and second regions of respectively relatively higher and lower luminescent intensities in each discharge cell, the first regions of substantially common relatively higher luminescent intensities being surrounded by the second portions of relatively lower luminescent intensities and defining a border therebetween; and shielding parts formed of the material of the bus electrodes and disposed with the respective bus electrodes on corresponding transparent electrodes extending in the longitudinal direction and aligned in opposed pairs with respective discharge cells, opposed edges of each pair of opposed shielding parts having configurations defining a relatively larger space therebetween corresponding to and thereby permitting light to exit from the first regions of each cell, and a relatively smaller space therebetween, corresponding to and thereby shielding incident light from an exterior of the front substrate from entering the discharge cell in the second regions, to improve a bright room contrast ratio of the plasma display panel.

30. A plasma display panel, comprising:

a plurality of discharge electrodes arranged on an interior main surface of a front substrate, an exterior main surface thereof comprising a display surface, each of said discharge electrodes comprising a bus electrode and a transparent electrode connected to said bus electrode and extending in a longitudinal direction, opposing portions of adjacent discharge electrodes, spaced in a lateral direction, defining corresponding discharge cells; and shielding parts to shield light from an exterior of the front substrate, which is incident on the shielding part, from entering the respective discharge cells, each shielding part being formed on a corresponding said transparent electrode, disposed laterally to the corresponding bus electrode, and part of an outline of each of the shielding parts being formed along an outline of a discharge area.

* * * * *

UNITED STATES PATENT AND TRADEMARK OFFICE

CERTIFICATE OF CORRECTION

PATENT NO. : 7,012,370 B2
APPLICATION NO. : 09/881740
DATED : March 14, 2006
INVENTOR(S) : Yoshikazu Kanazawa et al.

It is certified that error appears in the above-identified patent and that said Letters Patent is hereby corrected as shown below:

Column 12, line 48, after "and" insert -- not --

Column 12, line 49, delete "electrode" and insert -- electrodes --

Column 15, line 27, change "nterconnecting" to -- interconnecting --

Column 18, line 16, after "and" insert -- a --

Signed and Sealed this

Thirty-first Day of October, 2006

JON W. DUDAS
*Director of the United States Patent and Trademark Office*